US010899132B2

(12) United States Patent
Satake et al.

(10) Patent No.: US 10,899,132 B2
(45) Date of Patent: Jan. 26, 2021

(54) RECORDING HEAD RECOVERY SYSTEM AND INKJET RECORDING APPARATUS HAVING THE SAME

(71) Applicant: KYOCERA Document Solutions Inc., Osaka (JP)

(72) Inventors: Kenichi Satake, Osaka (JP); Yasutaka Inui, Osaka (JP); Takuma Araki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/926,592

(22) Filed: Jul. 10, 2020

(65) Prior Publication Data

US 2020/0338895 A1 Oct. 29, 2020

Related U.S. Application Data

(62) Division of application No. 15/868,162, filed on Jan. 11, 2018, now Pat. No. 10,744,773.

(30) Foreign Application Priority Data

Jan. 25, 2017 (JP) ..... 2017-011347
Feb. 17, 2017 (JP) ..... 2017-027920
Feb. 23, 2017 (JP) ..... 2017-031740

(51) Int. Cl.
*B41J 2/165* (2006.01)
*B41J 2/21* (2006.01)

(52) U.S. Cl.
CPC ..... *B41J 2/16544* (2013.01); *B41J 2/16538* (2013.01); *B41J 2/16552* (2013.01); *B41J 2/16585* (2013.01); *B41J 2/21* (2013.01)

(58) Field of Classification Search
None
See application file for complete search history.

(56) References Cited

U.S. PATENT DOCUMENTS 7,478,897 B2 1/2009 Takagi ..... 347/21
2006/0066663 A1 3/2006 Takagi ..... 347/33
2007/0165063 A1 7/2007 Horie ..... 347/33
(Continued)

FOREIGN PATENT DOCUMENTS

JP 2006-88617 A 4/2006
JP 2007-83496 A 4/2007
(Continued)

OTHER PUBLICATIONS

Extended European Search Report dated Jun. 26, 2018, issued to European Application No. 18151633.7.
(Continued)

*Primary Examiner* — Alejandro Valencia
(74) *Attorney, Agent, or Firm* — Stein IP, LLC

(57) ABSTRACT

A recording head recovery system includes a recording head and a wiper. The recording head includes an ink ejection surface provided with an ink ejection region in which ink ejection ports are formed. The recording head is disposed on a wiping direction upstream side of the ink ejection region, and a cleaning liquid supply region in which cleaning liquid supply ports for supplying cleaning liquid are formed. The pressure contact angle of the tip of the wiper to the ink ejection surface is decreased after the wiper passes the cleaning liquid supply region before reaching the ink ejection region.

7 Claims, 13 Drawing Sheets

(56) References Cited

U.S. PATENT DOCUMENTS

| | | | | |
|---|---|---|---|---|
| 2009/0046122 | A1 | 2/2009 | Inoue | 347/33 |
| 2012/0154485 | A1 | 6/2012 | Shimizu | 347/33 |

FOREIGN PATENT DOCUMENTS

| | | | |
|---|---|---|---|
| JP | 2007-190818 | A | 8/2007 |
| JP | 2008-201102 | A | 9/2008 |
| JP | 2009-45795 | A | 3/2009 |

OTHER PUBLICATIONS

Japanese Office Action dated Oct. 8, 2019, issued to Japanese Application No. 2017-011347.
Japanese Office Action dated Oct. 8, 2019, issued to Japanese Application No. 2017-031740.
Japanese Office Action dated Oct. 23, 2019, issued by the Japanese Patent Office in corresponding application JP 2017-027920.

RECORDING HEAD RECOVERY SYSTEM AND INKJET RECORDING APPARATUS HAVING THE SAME

INCORPORATION BY REFERENCE

This application is a divisional of U.S. application Ser. No. 15/868,162, filed Jan. 11, 2018 in the U.S. Patent and Trademark Office, which claims the benefit of priority from the corresponding Japanese Patent Applications No. 2017-011347 filed Jan. 25, 2017, No. 2017-027920 filed Feb. 17, 2017, and No. 2017-031740 filed Feb. 23, 2017, the entire contents of which are hereby incorporated by reference.

BACKGROUND

The present disclosure relates to a recording head recovery system having an ink ejection surface in which an ink ejection ports are formed so as to eject ink to a recording medium such as a paper sheet, a head cleaning mechanism, and an inkjet recording apparatus including the same.

As a recording apparatus such as a facsimile, a copier, or a printer, an inkjet recording apparatus that forms images by ejecting ink is widely used because it can form a high definition images.

In this inkjet recording apparatus, micro ink droplets (hereinafter referred to as mist) ejected together with ink droplets for recording images and rebound mist generated when the ink droplets are adhered to the recording medium may be adhered and fixed to the ink ejection surface of the recording head. As the mist on the ink ejection surface is gradually increased and overlaps the ink ejection ports, deterioration of ink ejection straightness (bending flying), non-ejection, or the like may occur, so that printing performance of the recording head is deteriorated.

Therefore, in order to clean the ink ejection surface of the recording head, there is known an inkjet recording apparatus in which a plurality of cleaning liquid supply ports are disposed in a part outside the ink ejection region in which a plurality of ink ejection ports are formed (a part on an upstream side in a wiping direction of a wiper) in the ink ejection surface. In this inkjet recording apparatus, after supplying cleaning liquid from the cleaning liquid supply ports, the wiper is moved along the ink ejection surface from outside of the cleaning liquid supply port, so that the wiper can wipe the ink ejection surface while holding the cleaning liquid. In this way, a recording head recovery process can be performed.

SUMMARY

A recording head recovery system of a first aspect of the present disclosure includes a recording head, a wiper, a wipe unit, and a control unit. The recording head includes an ink ejection surface provided with an ink ejection region in which a plurality of ink ejection ports are formed for ejecting ink onto a recording medium. The wiper wipes the ink ejection surface in a predetermined direction. The wipe unit holds the wiper and moves the wiper in an up and down direction while moving the same along the ink ejection surface. The control unit controls the wipe unit. The recording head includes a cleaning liquid supply region disposed on an upstream side in a wiping direction of the ink ejection region, the wiping direction in which the wiper wipes the ink ejection surface, the cleaning liquid supply region in which a plurality of cleaning liquid supply ports for supplying cleaning liquid are formed. The control unit is capable of performing a recovery operation of the recording head including a cleaning liquid supply operation for supplying the cleaning liquid from the cleaning liquid supply port, and a wipe operation for wiping the ink ejection surface with the wiper in a state holding the cleaning liquid, by moving the wiper from a position on the wiping direction upstream side of the cleaning liquid supply region to a position on the wiping direction downstream side of the ink ejection region. In the wipe operation, a height position of a lower end part of the wiper when passing the cleaning liquid supply region is lower than a height position of the lower end part of the wiper when wiping the ink ejection region.

A recording head recovery system of a second aspect of the present disclosure includes recording a head, a wiper, a wiper holding member, a rotation mechanism, and a control unit. The recording head includes an ink ejection surface provided with an ink ejection region in which a plurality of ink ejection ports are formed for ejecting ink onto a recording medium. The wiper wipes the ink ejection surface in a predetermined direction. The wiper holding member holds the wiper, moves the same along the ink ejection surface, and is capable of rotating about a rotation shaft extending in a head width direction perpendicular to a wiping direction in which the wiper wipes the ink ejection surface. The rotation mechanism rotates the wiper holding member about the rotation shaft. The control unit controls the rotation mechanism. The recording head includes a cleaning liquid supply region disposed on an upstream side in the wiping direction of the ink ejection region, the cleaning liquid supply region in which a plurality of cleaning liquid supply ports for supplying cleaning liquid are formed. The control unit is capable of performing a recovery operation of the recording head including a cleaning liquid supply operation for supplying the cleaning liquid from the cleaning liquid supply port, and a wipe operation for wiping the ink ejection surface with the wiper in a state holding the cleaning liquid by moving the wiper from a position on the wiping direction upstream side of the cleaning liquid supply region to a position on the wiping direction downstream side of the ink ejection region. In the wipe operation, the control unit rotates the wiper holding member so that a pressure contact angle of a tip of the wiper to the ink ejection surface is decreased after the wiper passes the cleaning liquid supply region before reaching the ink ejection region.

A head cleaning mechanism of a third aspect of the present disclosure includes recording a head, and a wiper. The recording head includes an ink ejection surface in which a plurality of ink ejection ports are formed for ejecting ink onto a recording medium, and a cleaning liquid supply surface in which a plurality of cleaning liquid supply ports for supplying cleaning liquid are formed. The wiper wipes the ink ejection surface in a predetermined direction. The recording head are constituted of an ink ejection head portion including the ink ejection surface, and a cleaning liquid supplying head portion disposed on an upstream side in a wiping direction of the ink ejection head portion, the wiping direction in which the wiper wipes the ink ejection surface, the cleaning liquid supplying head portion including the cleaning liquid supply surface. The cleaning liquid supply surface includes a lower surface disposed in parallel to the ink ejection surface on the wiping direction upstream side of the ink ejection surface adjacent to the same. A length of the lower surface in the head width direction perpendicular to the wiping direction is larger than a length of the ink ejection surface in the head width direction.

Other objects of the present disclosure and specific advantages obtained by the present disclosure will become more apparent from the description of embodiments given below.

DETAILED DESCRIPTION

Hereinafter, embodiments of the present disclosure are described with reference to the drawings.

First Embodiment

Figure 1:
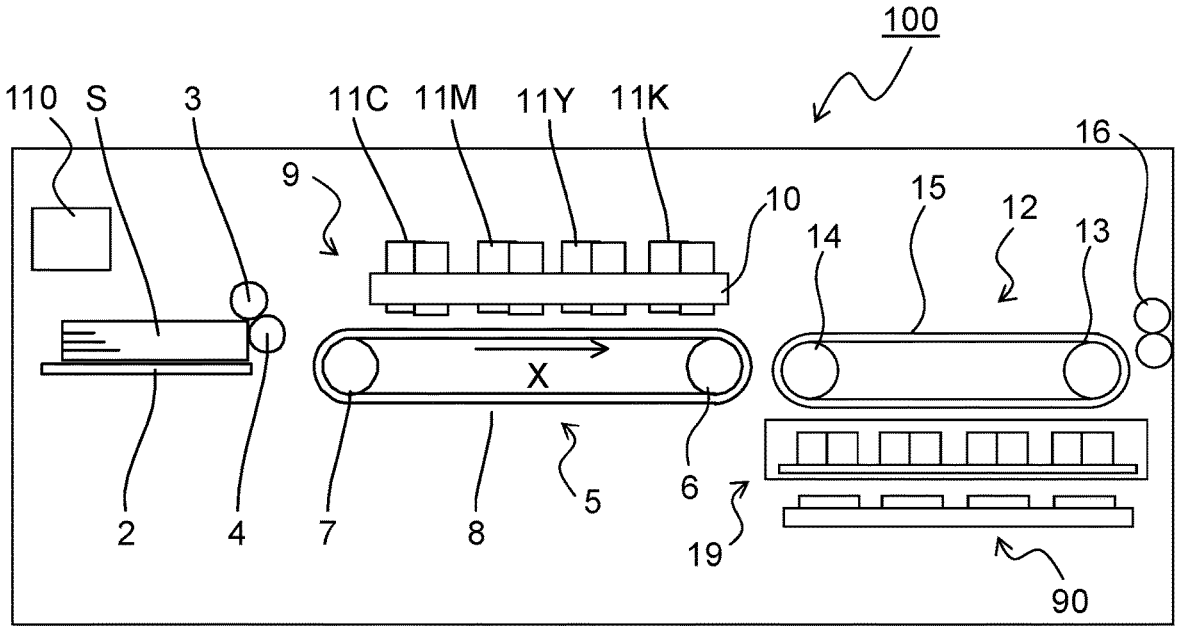
FIG. 1 is a diagram showing a structure of an inkjet recording apparatus equipped with a recording head of a first embodiment of the present disclosure.

As shown in FIG. 1, a paper feed tray 2 for storing paper sheets S (recording media) is disposed in a left side part of an inkjet recording apparatus 100 of a first embodiment of the present disclosure, and one end part of this paper feed tray 2 is provided with a sheet feed roller 3 for feeding and conveying stored paper sheets S to a first conveying unit 5 one by one from the top paper sheet S, and a driven roller 4 pressed to the sheet feed roller 3 so as to rotate to follow the same.

On a downstream side (the right side in FIG. 1) of the sheet feed roller 3 and the driven roller 4 in a paper sheet conveying direction (arrow X direction), the first conveying unit 5 and a recording portion 9 are disposed. The first conveying unit 5 has a structure including a first drive roller 6, a first driven roller 7, and a first conveyor belt 8 stretched between the first drive roller 6 and the first driven roller 7. The first drive roller 6 is driven to rotate in a clockwise direction by a control signal from a control unit 110 that controls the entire inkjet recording apparatus 100, and hence the paper sheet S held on the first conveyor belt 8 is conveyed in the arrow X direction.

Figure 2:
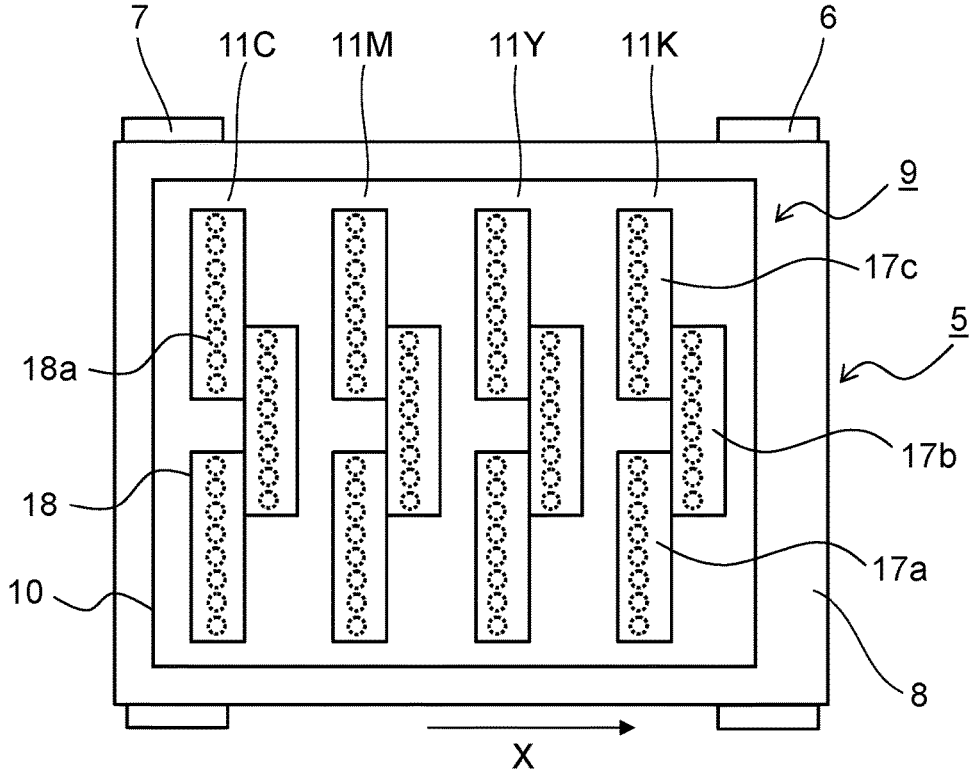
FIG. 2 is a top view of a first conveying unit and a recording portion of the inkjet recording apparatus shown in FIG. 1.

The recording portion 9 includes a head housing 10, and line heads 11C, 11M, 11Y, and 11K held by the head housing 10. These line heads 11C to 11K are supported at a height such that a predetermined space (e.g. 1 mm) is formed between a conveying surface of the first conveyor belt 8 and the heads. As shown in FIG. 2, a plurality of (e.g. three) recording heads 17*a* to 17*c* are arranged in a zig-zag manner along a paper sheet width direction (up and down direction in FIG. 2) perpendicular to the paper sheet conveying direction.

Figure 3:
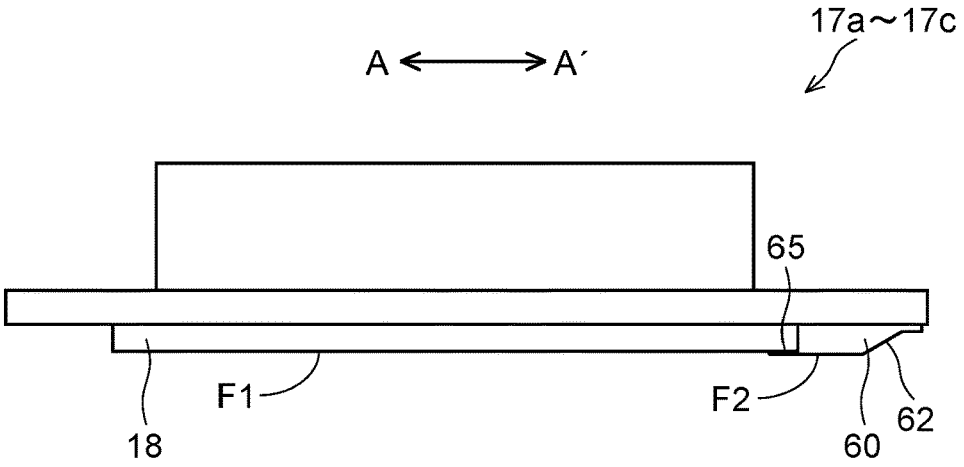
FIG. 3 is a diagram of the recording head constituting a line head of the recording portion.
Figure 4:
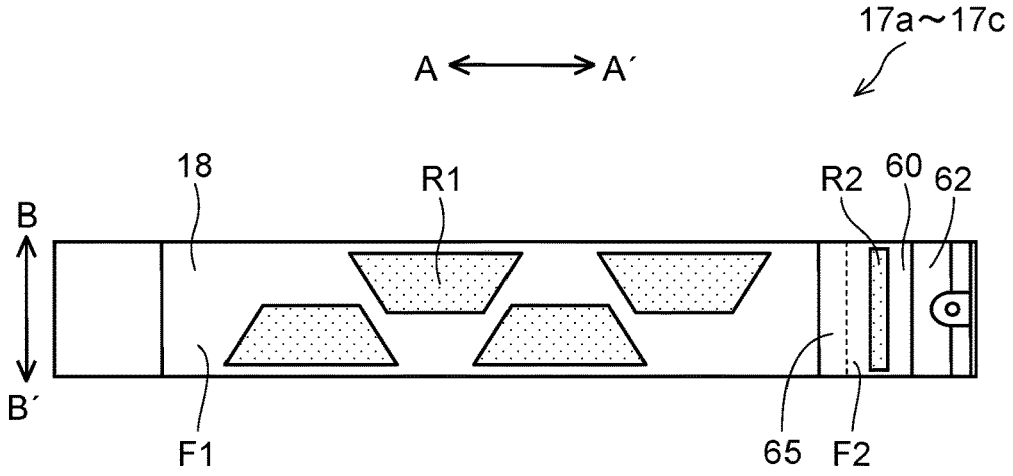
FIG. 4 is a diagram of the recording head viewed from an ink ejection surface side.

As shown in FIGS. 3 and 4, an ink ejection surface F1 of a head portion (ink ejection head portion) 18 of each of the recording heads 17*a* to 17*c* is provided with an ink ejection region R1 in which multiple ink ejection ports 18*a* (see FIG.

2) are arranged. An opening diameter of the ink ejection port 18*a* is set to 20 μm, for example. At least the ink ejection surface F1 of the head portion 18 is made of stainless steel (SUS), for example. Water repellent treatment is performed on the ink ejection surface F1 by applying fluorine or silicone water repellent. Note that the recording heads 17*a* to 17*c* have the same shape and structure, and therefore the recording heads 17*a* to 17*c* are shown in one diagram in FIGS. 3 and 4.

The recording heads 17*a* to 17*c* constituting the line heads 11C to 11K are supplied with four color (cyan, magenta, yellow, and black) ink stored in ink tanks (not shown) for each color of the line heads 110 to 11K, respectively.

Each of the recording heads 17*a* to 17*c* ejects ink from the ink ejection port 18*a* to the paper sheet S sucked and held to be conveyed by the conveying surface of the first conveyor belt 8 according to image data received from an external computer based on a control signal from the control unit 110 (see FIG. 1). In this way, on the paper sheet S on the first conveyor belt 8, the cyan, magenta, yellow, and black color ink are superimposed to form a color image.

In addition, the recording heads 17*a* to 17*c* are provided with a cleaning liquid supply member (cleaning liquid supplying head portion) 60, which supplies cleaning liquid. The cleaning liquid supply member 60 is disposed adjacent to the head portion 18 on an upstream side (the right side in FIG. 3) of a wiping direction of wipers 35*a* to 35*c* described later. The cleaning liquid supply member 60 has a cleaning liquid supply surface F2 including a cleaning liquid supply region R2 in which a plurality of cleaning liquid supply ports 60*a* (see FIG. 6) that supplies the cleaning liquid are arranged. An opening diameter of the cleaning liquid supply port 60*a* is set to 0.1 mm, for example, which is larger than the opening diameter of the ink ejection port 18*a*. Note that the cleaning liquid supply member 60 is made of resin.

Figure 5:
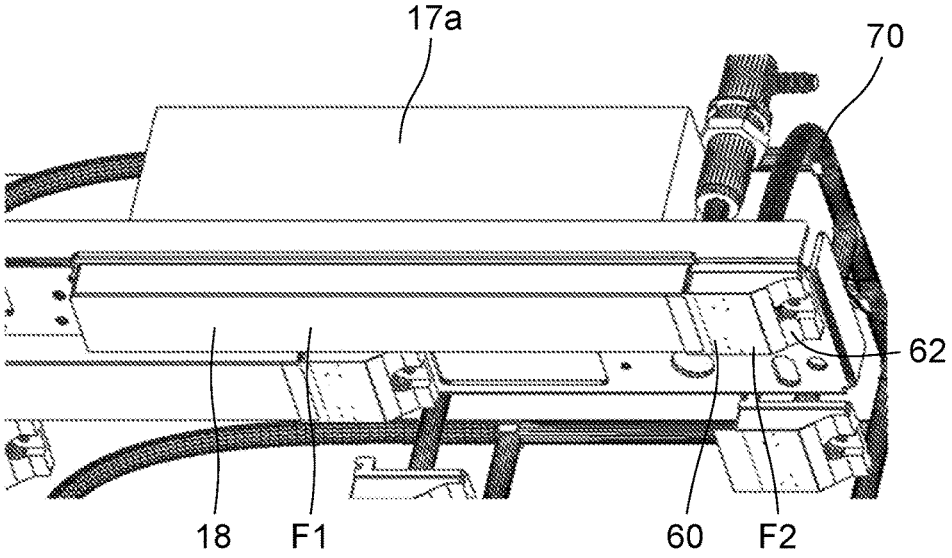
FIG. 5 is a diagram of the recording head and its vicinity viewed from obliquely below.

As shown in FIGS. 3 and 5, a part of the cleaning liquid supply member 60 on the wiping direction upstream side (the right side in FIG. 3) of the cleaning liquid supply surface F2 is provided with an inclined surface 62. The part of the cleaning liquid supply member 60 on the wiping direction downstream side (the left side in FIG. 3) is provided with a thin plate portion 65 having a thin plate-like shape. The thin plate portion 65 is disposed to overlap under an end of the ink ejection surface F1 of the head portion 18. In this way, a step corresponding to a thickness of the thin plate portion 65 is formed at a boundary part between the cleaning liquid supply surface F2 and the ink ejection surface F1. In addition, the thin plate portion 65 has a thickness of 0.1 mm, for example. Therefore, a height position H2 of the cleaning liquid supply surface F2 (see FIG. 15) is lower than a height position H1 of the ink ejection surface F1 (see FIG. 15) by 0.1 mm, for example. Note that in FIG. 5 and in FIG. 8 described later, for easy understanding, only a part of the recording heads 17*a* to 17*c* is shown.

Figure 6:
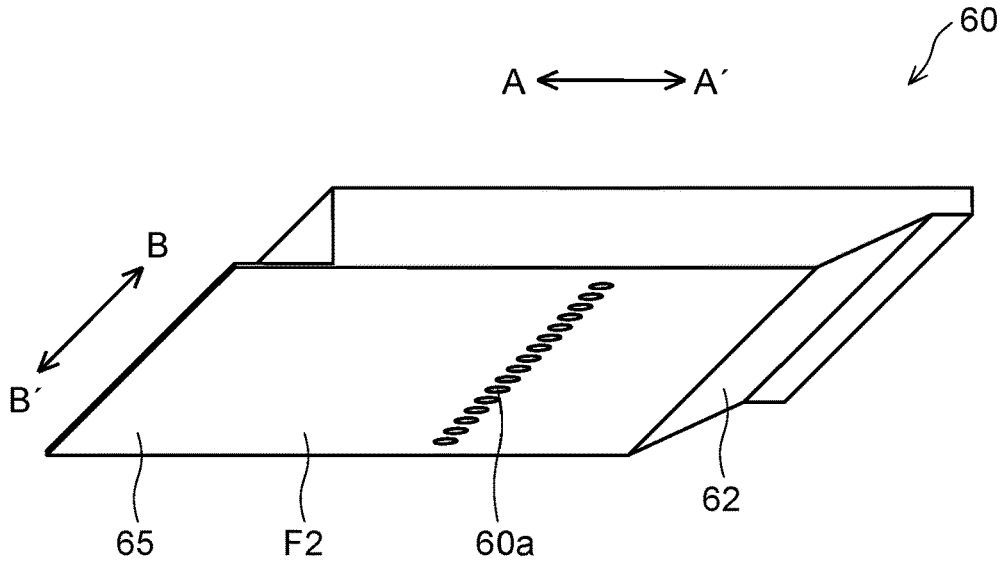
FIG. 6 is a diagram of a cleaning liquid supply member of the recording head viewed from obliquely below.
Figure 7:
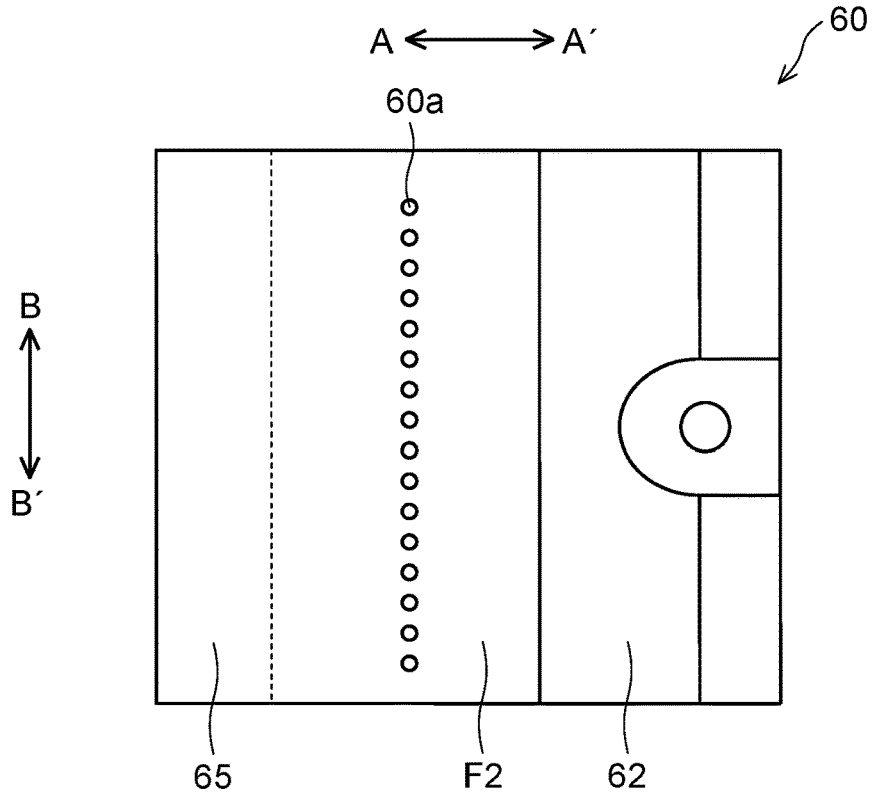
FIG. 7 is a diagram of the cleaning liquid supply member of the recording head viewed from below.

As shown in FIGS. 6 and 7, a plurality of the cleaning liquid supply ports 60*a* are disposed at a predetermined pitch in a head width direction (arrow BB' direction) perpendicular to the wiping direction (arrow A direction). Note that only one row of the plurality of cleaning liquid supply ports 60*a* disposed along the head width direction is shown in the diagram, but a plurality of rows of them may be disposed to be adjacent to each other in the wiping direction (in the arrow A direction).

Figure 8:
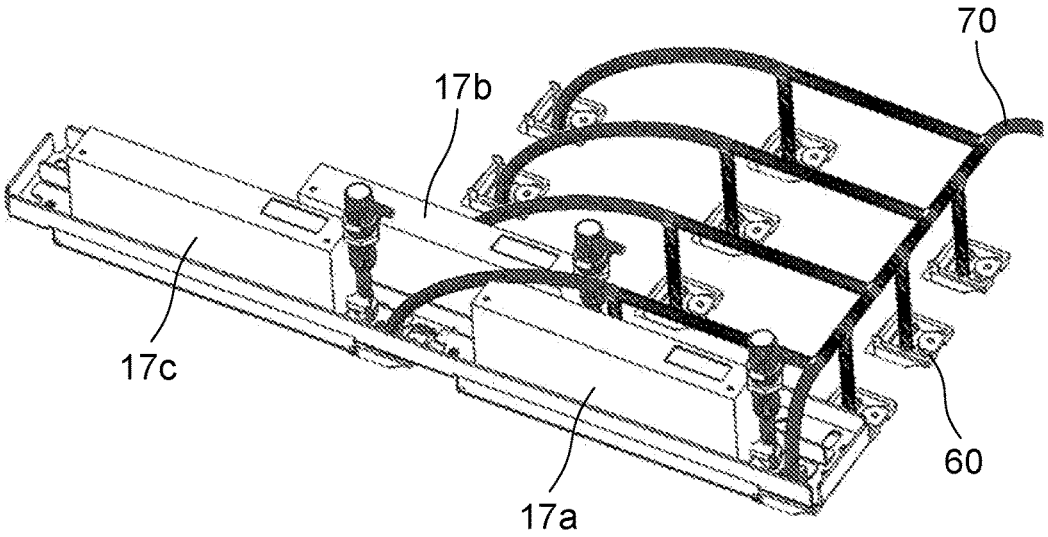
FIG. 8 is a diagram of the recording head and its vicinity viewed from obliquely above.

As shown in FIGS. 5 and 8, the cleaning liquid supply member 60 is connected to a downstream end of a supply path 70 constituted of a tube in which the cleaning liquid flows. An upstream end of the supply path 70 is connected to a cleaning liquid supply mechanism (not shown). The cleaning liquid supply mechanism is constituted of a tank (not shown) that stores the cleaning liquid, and a pump (not shown) that pumps up the cleaning liquid from the tank to the supply path 70.

The supply path 70 is constituted of a single path at the upstream end and branches repeatedly toward the downstream side so as to be branched into 12 paths. The 12 paths are connected to the cleaning liquid supply members 60 of the recording heads 17*a* to 17*c*, respectively.

In this inkjet recording apparatus 100, in order to clean the ink ejection surfaces F1 of the recording heads 17*a* to 17*c*, when starting to print after a long halt and between printing operations, ink is forcibly ejected from all the ink ejection ports 18*a* of the recording heads 17*a* to 17*c*, while the cleaning liquid is supplied to the cleaning liquid supply surface F2 from all the cleaning liquid supply ports 60*a* of the recording heads 17*a* to 17*c* (see FIG. 6). Then, the ink ejection surface F1 is wiped by the wipers 35*a* to 35*c* described later, and preparation for the next printing operation is made.

With reference to FIG. 1 again, a second conveying unit 12 is disposed on the downstream side (the right side in FIG. 1) of the first conveying unit 5 in the paper sheet conveying direction. The second conveying unit 12 has a structure including a second drive roller 13, a second driven roller 14, and a second conveyor belt 15 stretched between the second drive roller 13 and the second driven roller 14. The second drive roller 13 is driven to rotate in the clockwise direction, and hence the paper sheet S held on the second conveyor belt 15 is conveyed in the arrow X direction.

The paper sheet S with the ink image recorded by the recording portion 9 is sent to the second conveying unit 12, and the ink ejected to the surface of the paper sheet S is dried while passing through the second conveying unit 12. In addition, a wipe unit 19 and a cap unit 90 are disposed below the second conveying unit 12. The wipe unit 19 moves to below the recording portion 9 when performing the above-mentioned wipe operation using the wipers 35*a* to 35*c*, so as to wipe off the ink ejected forcibly from the ink ejection ports 18*a* of the recording heads 17*a* to 17*c* and the cleaning liquid supplied from the cleaning liquid supply ports 60*a*, and to collect the wiped ink and cleaning liquid. In addition, the wipe unit 19 is configured to be capable of moving in the up and down direction with a drive mechanism (not shown) including a drive source such as a stepping motor. When the wipe unit 19 moves up or down, the wipers 35*a* to 35*c* are also moved up or down. When capping the ink ejection surfaces F1 (see FIG. 3) of the recording heads 17*a* to 17*c*, the cap unit 90 horizontally moves to below of the recording portion 9 and further moves upward so as to be mounted on lower surfaces of the recording heads 17*a* to 17*c*.

In addition, the downstream side of the second conveying unit 12 in the paper sheet conveying direction is provided with a discharge roller pair 16 that discharges the paper sheet S with the recorded image to the outside of the apparatus main body, and a discharge tray (not shown) on which the paper sheet S is placed after being discharged to the outside of the apparatus is provided on the downstream side of the discharge roller pair 16.

Figure 9:
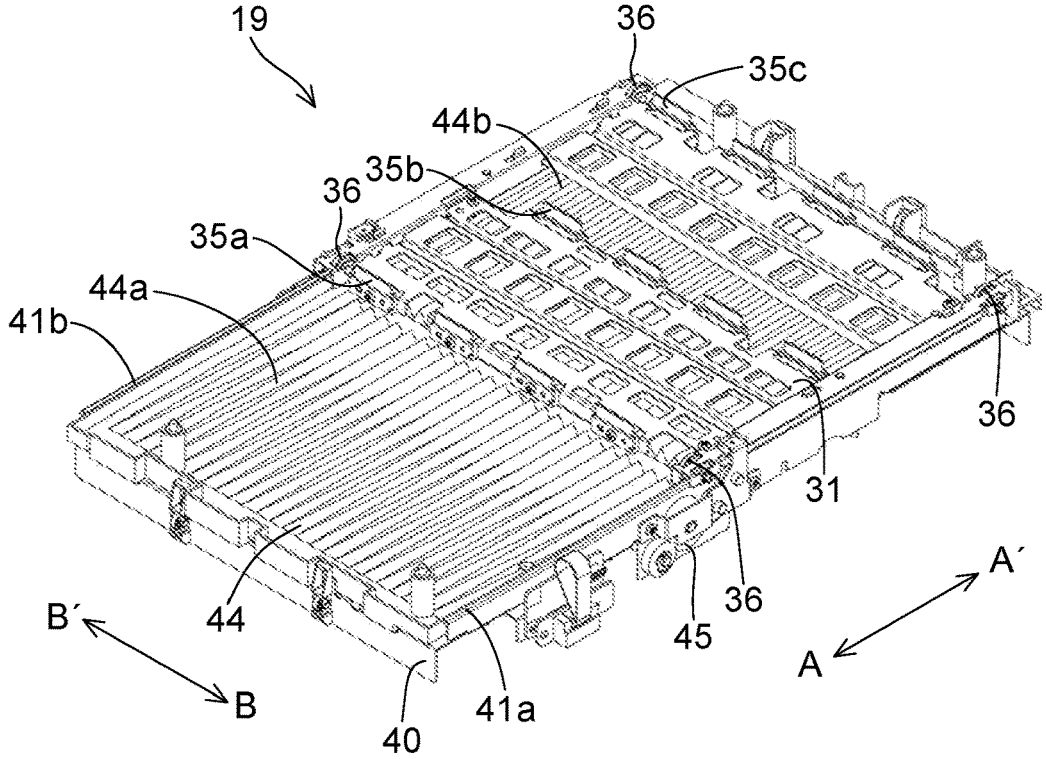
FIG. 9 is a diagram of a wipe unit viewed from obliquely above.
Figure 10:
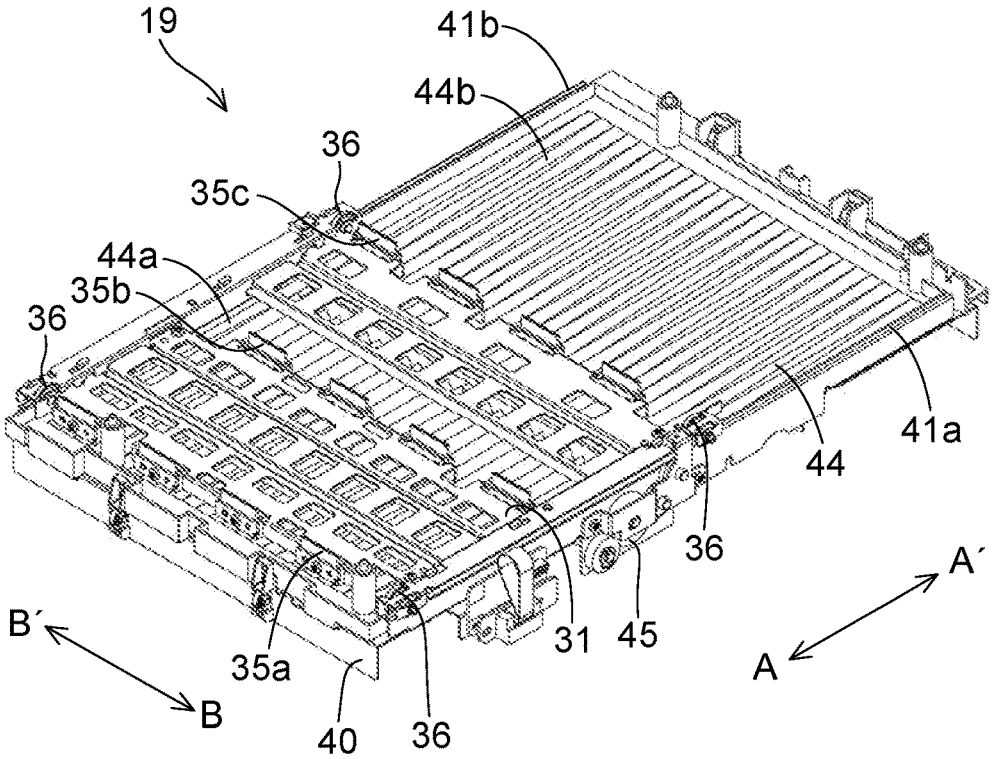
FIG. 10 is a diagram of the wipe unit viewed from obliquely above.

Next, a detailed structure of the wipe unit 19 is described. As shown in FIGS. 9 and 10, the wipe unit 19 is constituted of a rectangular wiper carriage 31 to which a plurality of wipers 35*a* to 35*c* are fixed, which can move along the ink ejection surface F1, and a support frame 40 that supports the wiper carriage 31.

Rail portions 41*a* and 41*b* are formed on opposed edges of an upper surface of the support frame 40, and rollers 36 disposed at four corners of the wiper carriage 31 abut the rail portions 41*a* and 41*b* so that the wiper carriage 31 is supported by the support frame 40 in a slidable manner in an arrow AA' direction.

A wiper carriage moving motor 45 for moving the wiper carriage 31 in the horizontal direction (arrow AA' direction), and a gear train (not shown) that engages with the wiper carriage moving motor 45 and rack teeth (not shown) of the wiper carriage 31 are attached to the outside of the support frame 40. When the wiper carriage moving motor 45 rotates forward and backward, the gear train rotates forward and backward so that the wiper carriage 31 moves in the horizontal direction (arrow AA' direction) in a reciprocating manner.

The wipers 35*a* to 35*c* are elastic members (e.g. rubber members made of EPDM) for wiping off the cleaning liquid supplied from the cleaning liquid supply ports 60*a* of the recording heads 17*a* to 17*c* (see FIG. 6) to the cleaning liquid supply surface F2 and the ink extruded from the ink ejection port 18*a*. The wipers 35*a* to 35*c* are pressed to contact with the part (e.g. the inclined surface 62) of the cleaning liquid supply member 60 on the wiping direction downstream side of the cleaning liquid supply region R2 (see FIG. 4). When the wiper carriage 31 moves, the wipers 35*a* to 35*c* wipe the cleaning liquid supply surface F2 and the ink ejection surface F1 in a predetermined direction (in the arrow A direction).

The four wipers 35*a* are disposed with substantially equal spaces. Similarly, four wipers 35*b* as well as four wipers 35*c* are disposed with substantially equal spaces. The wipers 35*a* and 35*c* are respectively disposed at positions corresponding to the left and right recording heads 17*a* and 17*c* (see FIG. 2) constituting the line heads 11C to 11K. In addition, the wiper 35*b* is disposed at a position corresponding to the center recording head 17*b* (see FIG. 2) constituting the line heads 11C to 11K and is fixed by shifting from the wipers 35*a* and 35*c* by a predetermined distance in a direction perpendicular to a moving direction of the wiper carriage 31 (arrow AA' direction).

The upper surface of the support frame 40 is provided with a collection tray 44 for collecting waste ink and cleaning liquid wiped off the ink ejection surface F1 by the wipers 35*a* to 35*c*. A substantially middle part of the collection tray 44 is provided with an exit hole (not shown), and tray surfaces 44*a* and 44*b* on both sides of the exit hole have down slopes toward the exit hole. The waste ink and cleaning liquid wiped off the ink ejection surface F1 by the wipers 35*a* to 35*c* drop to the tray surfaces 44*a* and 44*b* and flow to the exit hole (not shown). After that, the waste ink and cleaning liquid passes through an ink collection path (not shown) connected to the exit hole and are collected to a collection tank (not shown).

Next, a recovery operation of the recording heads 17*a* to 17*c* using the wipe unit 19 in the inkjet recording apparatus 100 of this embodiment is described. Note that the recovery operation of the recording heads 17*a* to 17*c* described below are performed by controlling operations of the recording heads 17*a* to 17*c*, the wipe unit 19, and the like, based on the control signal from the control unit 110 (see FIG. 1).

Figure 11:
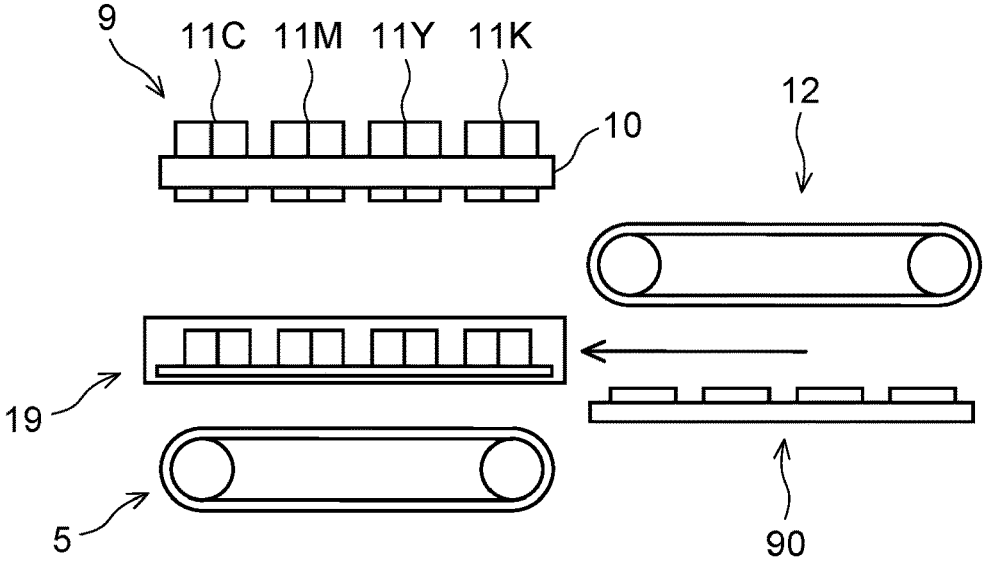
FIG. 11 is a diagram showing a state in which the wipe unit is disposed below the recording portion.

When the recovery operation of the recording heads 17*a* to 17*c* is performed, first as shown in FIG. 11, the control unit 110 (see FIG. 1) downwardly moves the first conveying unit 5 positioned below the recording portion 9. Then, the control unit 110 horizontally moves the wipe unit 19 positioned below the second conveying unit 12 so that it is positioned between the recording portion 9 and the first conveying unit 5. In this state, the wipers 35*a* to 35*c* of the wipe unit 19 (see FIG. 12) are positioned below the ink ejection surface F1 and the cleaning liquid supply surface F2 (see FIG. 12) of the recording heads 17*a* to 17*c*.

(Cleaning Liquid Supply Operation)

Figure 12:
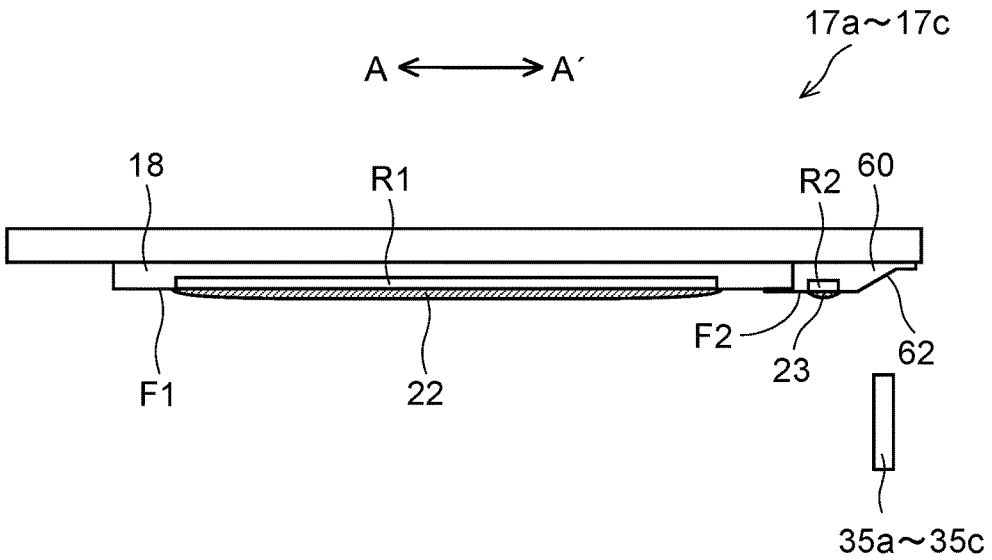
FIG. 12 is a diagram showing a state in which a wiper is disposed below the recording head.

Prior to a wiping operation (wipe operation described later), as shown in FIG. 12, the control unit 110 (see FIG. 1) supplies cleaning liquid 23 to the recording heads 17*a* to 17*c*. A predetermined amount of the supplied cleaning liquid 23 is supplied from the cleaning liquid supply ports 60*a* (see FIG. 6) to the cleaning liquid supply surface F2. Note that in the diagram, the cleaning liquid 23 is shown with hatching for easy understanding.

(Ink Extrusion Operation)

In addition, prior to the wiping operation (wipe operation described later), as shown in FIG. 12, the control unit 110 (see FIG. 1) supplies ink 22 to the recording heads 17*a* to 17*c*. The supplied ink 22 is forcibly extruded (purged) from the ink ejection port 18*a*. By this purging operation, thickened ink, foreign matters, and air bubbles in the ink ejection port 18*a* are discharged from the ink ejection port 18*a*. In this case, the purged ink 22 is extruded to the ink ejection surface F1 along a shape of the ink ejection region R1 in which the ink ejection port 18*a* exists. Note that in the diagram, the ink (purged ink) 22 is shown with hatching for easy understanding.

(Wipe Operation)

Figure 13:
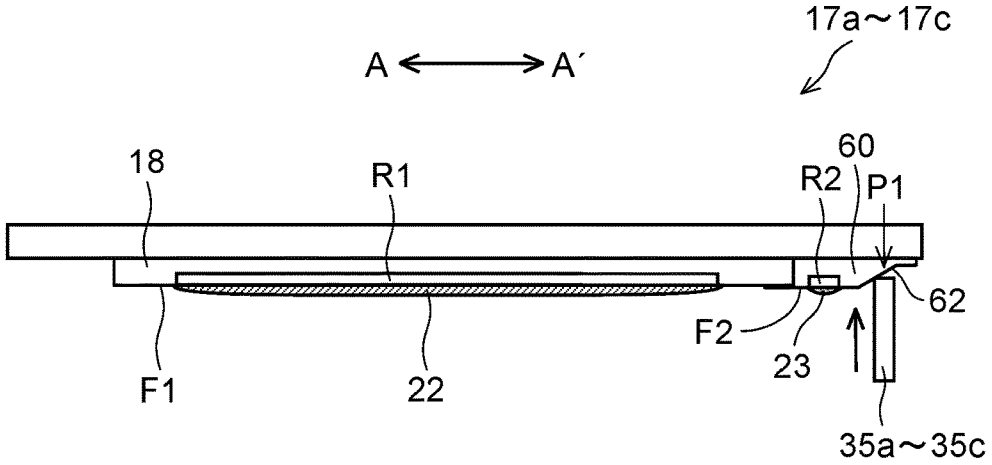
FIG. 13 is a diagram showing a state in which the wiper is moved upward from the state of FIG. 12.

As shown in FIG. 13, the control unit 110 upwardly moves the wipers 35*a* to 35*c* at a position P1 just below the inclined surface 62 of the cleaning liquid supply member 60 of the recording heads 17*a* to 17*c* (position on the wiping direction upstream side (the right side in FIG. 13) of the cleaning liquid supply region R2). In this case, the wipers 35*a* to 35*c* are moved upward so that upper surfaces of the wipers 35*a* to 35*c* become higher than the cleaning liquid supply surface F2 by approximately 0.5 mm. Note that when the wipers 35*a* to 35*c* are moved upward, the wipers 35*a* to 35*c* may or may not be pressed to contact with the inclined surface 62.

Figure 14:
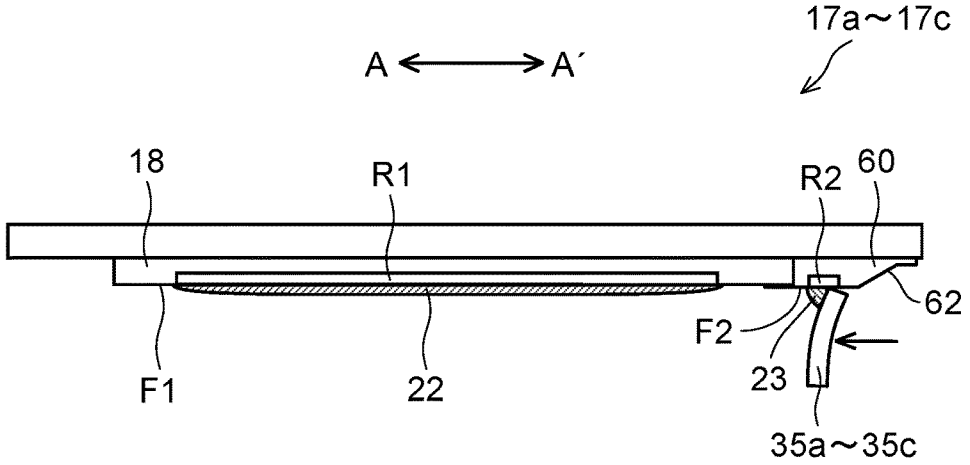
FIG. 14 is a diagram showing a state in which the wiper is pressed to contact with the cleaning liquid supply member and is moved in an arrow A direction from the state of FIG. 13.
Figure 15:
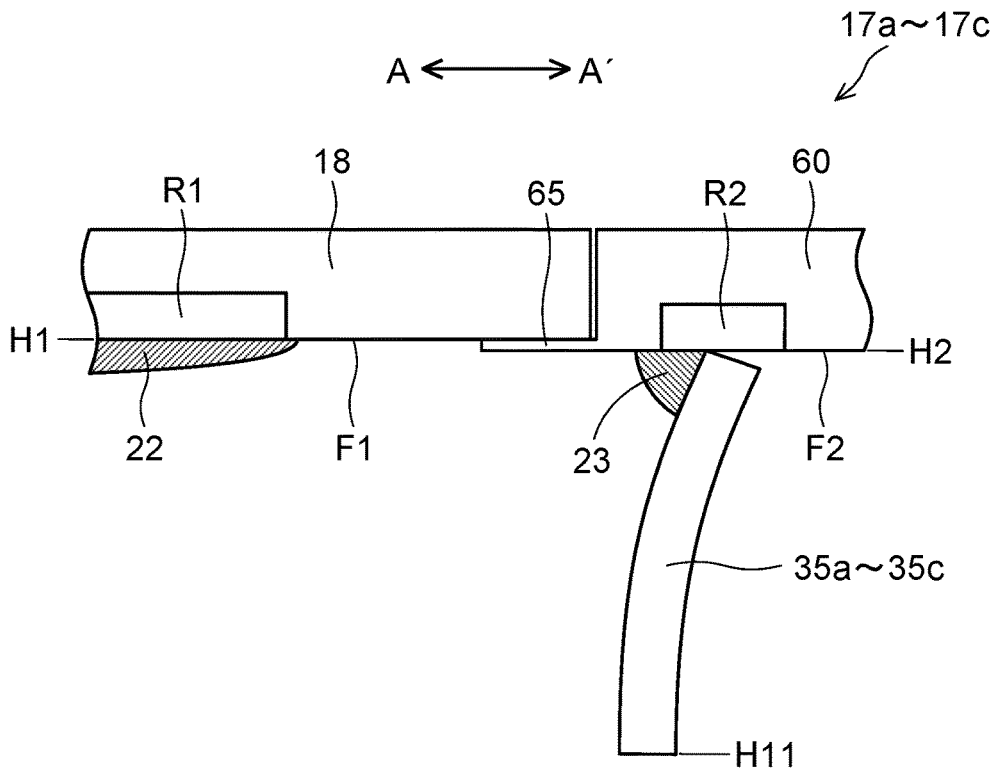
FIG. 15 is a diagram showing a state in which the wiper passes a cleaning liquid supply region.

From the state of FIG. 13, the control unit 110 horizontally moves the wipers 35*a* to 35*c* along the cleaning liquid supply surface F2 in a direction to the ink ejection region R1 (in the arrow A direction) as shown in FIGS. 14 and 15. In this way, after wiping off the cleaning liquid 23, the wipers 35*a* to 35*c* move in the direction to the ink ejection region R1 in a state holding the cleaning liquid 23. In this case, an overlap amount (bite amount) of the wipers 35*a* to 35*c* with the cleaning liquid supply surface F2 is approximately 0.5 mm.

Figure 16:
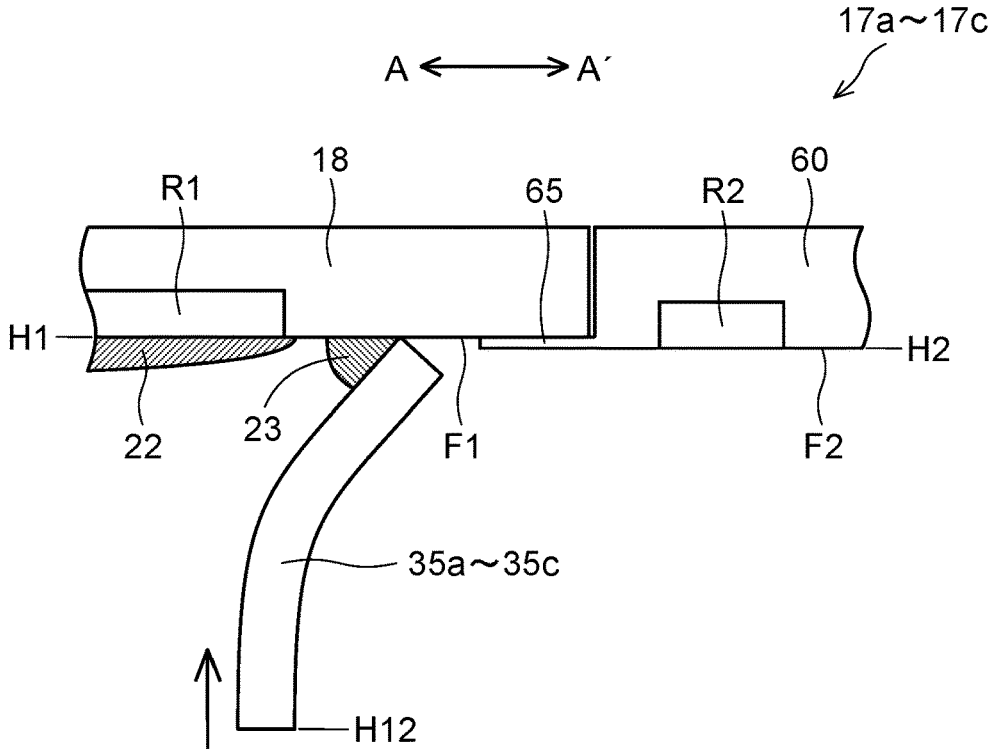
FIG. 16 is a diagram showing a state in which the wiper passes a step and after that the wiper is moved upward.

Then, the wipers 35*a* to 35*c* further moves in the left direction (in the arrow A direction), and when it passes the step at the boundary part between the cleaning liquid supply surface F2 and the ink ejection surface F1, the control unit 110 upwardly moves the wipers 35*a* to 35*c* by approximately 1.1 mm as shown in FIG. 16. In this way, a height position H12 of lower end parts of the wipers 35*a* to 35*c* when wiping the ink ejection surface F1 is higher than a height position H11 of the lower end parts of the wipers 35*a* to 35*c* when wiping (passing) the cleaning liquid supply surface F2 (see FIG. 15). In addition, a contact pressing force of the wipers 35*a* to 35*c* to the ink ejection surface F1 becomes larger than a contact pressing force of the wipers 35*a* to 35*c* to the cleaning liquid supply surface F2.

Figure 17:
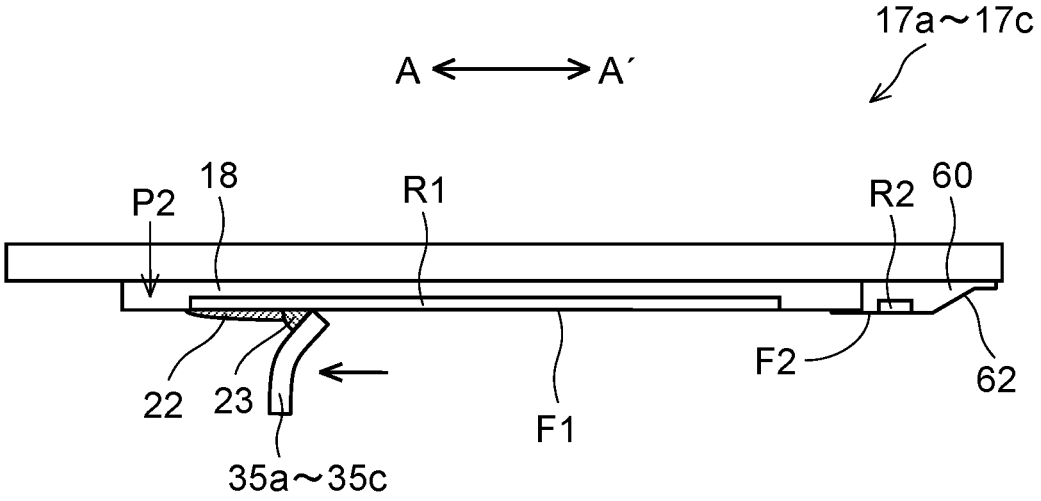
FIG. 17 is a diagram showing a state in which the wiper is further moved in the arrow A direction from the state of FIG. 16.

After that, as shown in FIG. 17, the wipers 35*a* to 35*c* further moves on the ink ejection surface F1 in the left direction (in the arrow A direction) while keeping the state holding the cleaning liquid 23. In this case, the cleaning liquid 23 and the ink (purged ink) 22 melts the ink droplets (waste ink) adhered and fixed to the ink ejection surface F1 and is wiped by the wipers 35*a* to 35*c*. Note that the overlap amount of the wipers 35*a* to 35*c* with the ink ejection surface F1 is approximately 1.5 mm, which is twice or more (approximately three times in this example) of the overlap amount (approximately 0.5 mm) of the wipers 35*a* to 35*c* with the cleaning liquid supply surface F2 when wiping the cleaning liquid supply region R2. Then, the wipers 35*a* to 35*c* further moves in the left direction (in the arrow A direction), and when they reach a position P2 on the opposite side of the cleaning liquid supply region R2 with respect to the ink ejection region R1, the movement in the left direction is stopped. Note that the cleaning liquid 23 and waste ink wiped by the wipers 35*a* to 35*c* are collected to the collection tray 44 provided to the wipe unit 19.

(Separation Operation)

Figure 18:
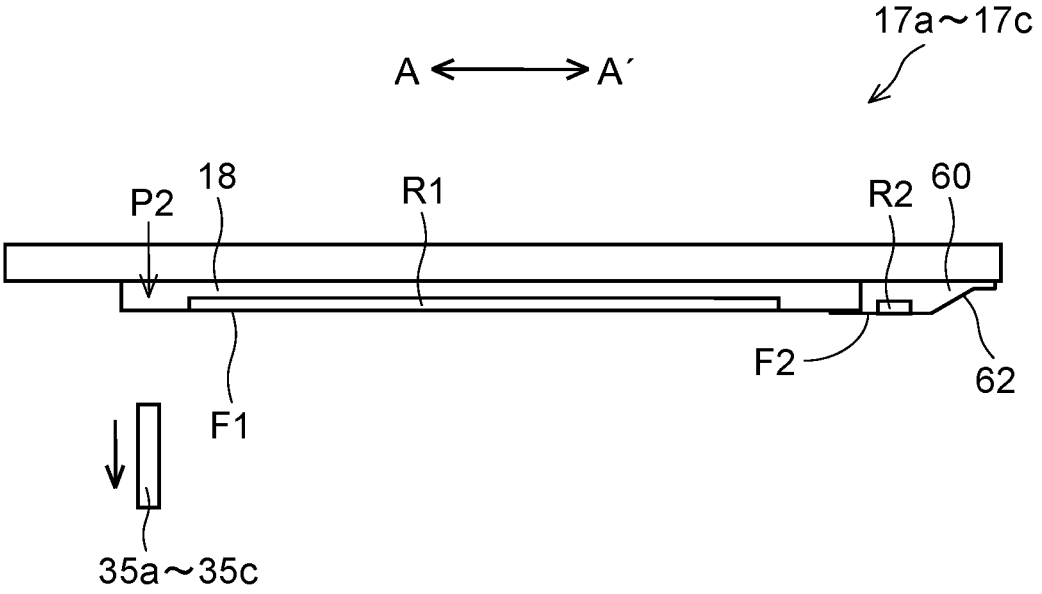
FIG. 18 is a diagram showing a state in which the wiper is further moved in the arrow A direction from the state of FIG. 17 and after that the wiper is moved downward so as to be separated from the ink ejection surface.

After performing the wipe operation, as shown in FIG. 18, the control unit 110 downwardly moves the wipers 35*a* to 35*c* so as to be separated from the ink ejection surface F1.

Finally, the control unit 110 horizontally moves the wipe unit 19 positioned between the recording portion 9 and the first conveying unit 5 so that it is positioned below the second conveying unit 12, and the control unit 110 moves the first conveying unit 5 upward to a predetermined position. In this way, the recovery operation of the recording heads 17*a* to 17*c* is finished.

In this embodiment, as described above, the control unit 110 moves the wipers 35*a* to 35*c* from the position P1 on the wiping direction upstream side of the cleaning liquid supply region R2 to the position P2 on the wiping direction downstream side of the ink ejection region R1, and hence the wipers 35*a* to 35*c* can perform the wipe operation of wiping the ink ejection surface F1 in the state holding the cleaning liquid 23. In this way, the ink ejection surface F1 can be cleaned.

In addition, in the wipe operation, the height position H11 of the lower end parts of the wipers 35*a* to 35*c* when wiping the cleaning liquid supply region R2 is lower than the height position H12 of the lower end parts of the wipers 35*a* to 35*c* when wiping the ink ejection region R1. In this way, the contact pressing force of the wipers 35*a* to 35*c* to the cleaning liquid supply surface F2 when wiping the cleaning liquid supply region R2 can be reduced, and hence tips of the wipers 35*a* to 35*c* can be prevented from being damaged by an edge of the cleaning liquid supply port 60*a*.

In addition, as described above, if the opening diameter of the cleaning liquid supply port 60*a* is larger than the opening diameter of the ink ejection port 18*a*, an entering amount of the tips of the wipers 35*a* to 35*c* into the cleaning liquid supply port 60*a* becomes more than an entering amount of the same into the ink ejection port 18*a*, and hence the tips of the wipers 35*a* to 35*c* are apt to be damaged. Therefore, it is particularly effective to apply the present disclosure in the case where the opening diameter of the cleaning liquid supply port 60*a* is larger than the opening diameter of the ink ejection port 18*a*.

In addition, as described above, if the height position H2 of the cleaning liquid supply surface F2 is lower than the height position H1 of the ink ejection surface F1, the contact pressing force of the wipers 35*a* to 35*c* to the cleaning liquid supply surface F2 is apt to be larger than the contact pressing force of the wipers 35*a* to 35*c* to the ink ejection surface F1, and hence the tips of the wipers 35*a* to 35*c* are apt to be damaged. Therefore, it is particularly effective to apply the present disclosure in the case where the height position H2 of the cleaning liquid supply surface F2 is lower than the height position H1 of the ink ejection surface F1.

In addition, as described above, the overlap amount of the wipers 35*a* to 35*c* with the cleaning liquid supply surface F2 when wiping the cleaning liquid supply region R2 is smaller than the overlap amount of the wipers 35*a* to 35*c* with the ink ejection surface F1 when wiping the ink ejection region R1. In this way, the contact pressing force of the wipers 35*a* to 35*c* to the cleaning liquid supply surface F2 can be smaller than the contact pressing force of the wipers 35*a* to 35*c* to the ink ejection surface F1, and hence the tips of the wipers 35*a* to 35*c* can be prevented more from being damaged.

In addition, as described above, the part on the wiping direction downstream side of the cleaning liquid supply member 60 is provided with the thin plate portion 65 having a thin plate-like shape, and the thin plate portion 65 is disposed to overlap under an end of the ink ejection surface F1. In this way, the cleaning liquid 23 can be prevented from entering a gap between the head portion 18 and the cleaning liquid supply member 60.

In addition, as described above, the overlap amount of the wipers 35*a* to 35*c* with the cleaning liquid supply surface F2 when wiping the cleaning liquid supply region R2 is less than or equal to a half of the overlap amount of the wipers 35*a* to 35*c* with the ink ejection surface F1 when wiping the ink ejection region R1. In this way, the contact pressing force of the wipers 35*a* to 35*c* to the cleaning liquid supply surface F2 when wiping the cleaning liquid supply region R2 can be sufficiently small, and hence the tips of the wipers 35*a* to 35*c* can be sufficiently prevented from being damaged by the edge of the cleaning liquid supply port 60*a*.

Second Embodiment

In the inkjet recording apparatus 100 of a second embodiment of the present disclosure, the thin plate portion 65 of the cleaning liquid supply member 60 has a thickness of 0.05 mm to 0.1 mm, for example. Therefore, the height position H2 of the cleaning liquid supply surface F2 (see FIG. 21) is lower than the height position H1 of the ink ejection surface F1 (see FIG. 21) by 0.05 mm to 0.1 mm, for example.

Figure 19:
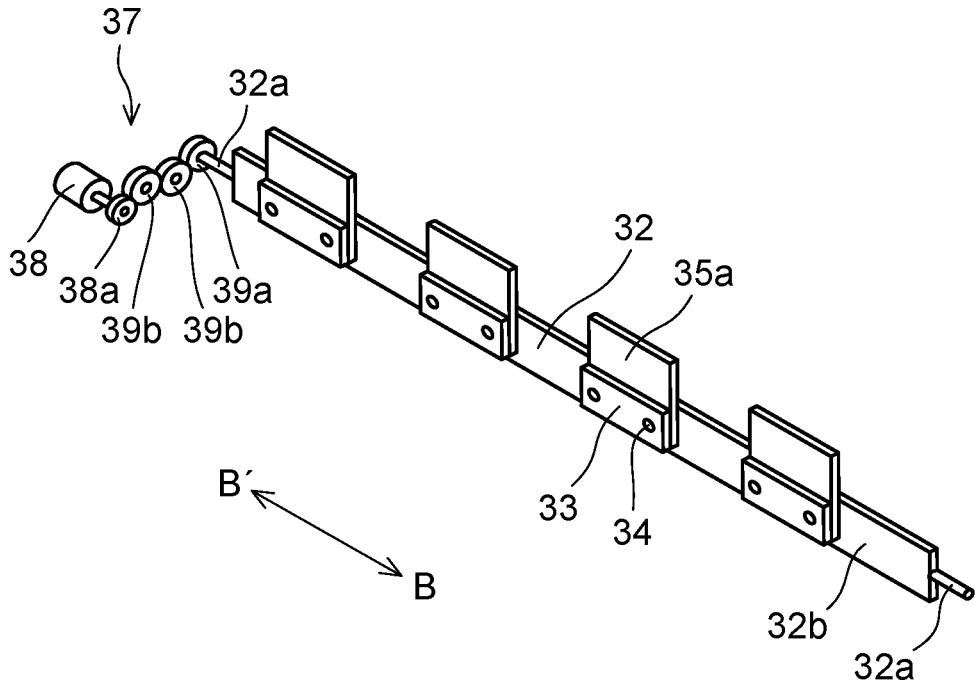
FIG. 19 is a diagram of a wiper holder stay, a rotation mechanism and their vicinity of an inkjet recording apparatus of a second embodiment of the present disclosure, viewed from obliquely above.
Figure 20:
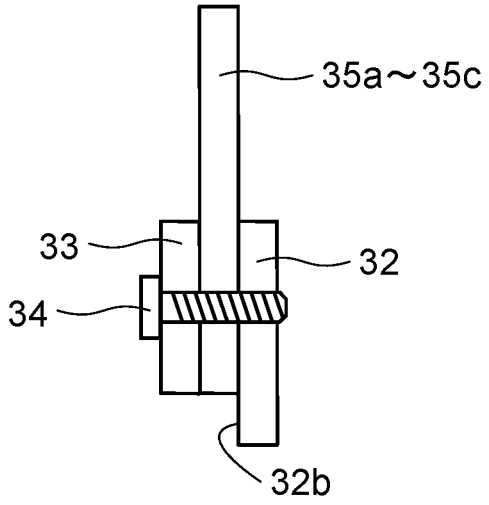
FIG. 20 is a diagram showing a mounting structure of the wiper to the wiper holder stay in the inkjet recording apparatus of the second embodiment of the present disclosure.

As shown in FIGS. 19 and 20, the four wipers 35*a* are held and sandwiched between one wiper holder stay (wiper holding member) 32 made of metal sheet extending in the head width direction (arrow BB' direction) and four pressing metal plates 33, and the four wipers 35*a* are fixed to the wiper holder stay 32 with screws 34. The four wipers 35*b* and the four wipers 35*c* are also fixed to the wiper holder stay 32 in the same manner.

Each end of the wiper holder stay 32 in the head width direction is provided with a rotation shaft 32*a* extending in the head width direction. Note that the wiper holder stay 32 may be fixed to one rotation shaft 32*a* that is longer than the wiper holder stay 32. The rotation shafts 32*a* are pivotally supported by bearings (not shown) of the wiper carriage 31, and the wiper holder stay 32 can rotate about the rotation shaft 32*a*. When the wiper carriage 31 moves in the arrow AA' direction, the wiper holder stay 32 moves in the arrow AA' direction in a state holding the wipers 35*a* to 35*c*.

One of the rotation shafts 32*a* is connected to a rotation mechanism 37 for rotating the wiper holder stay 32 about the rotation shaft 32*a*. The rotation mechanism 37 is constituted of an angle adjusting motor 38 constituted of a stepping motor, a gear 39*a* fixed to the rotation shaft 32*a*, and a gear train constituted of a plurality of gears 39*b* for linking between a motor gear 38*a* of the angle adjusting motor 38 and the gear 39*a*. When the angle adjusting motor 38 rotates forward and backward, the wiper holder stay 32 rotates forward and backward by a predetermined angle in the state holding the wipers 35*a* to 35*c*.

Other structures of the second embodiment are the same as those of the first embodiment described above.

Next, the recovery operation of the recording heads 17*a* to 17*c* using the wipe unit 19 in the inkjet recording apparatus 100 of this embodiment is described. The recovery operation of the recording heads 17*a* to 17*c* described below is performed by controlling operations of the recording heads 17*a* to 17*c*, the wipe unit 19, the rotation mechanism 37, and the like, based on the control signal from the control unit 110 (see FIG. 1). Note that in this embodiment, unlike the first embodiment described above, the wipers 35*a* to 35*c* are not moved upward when the wipers 35*a* to 35*c* pass the step at the boundary part between the cleaning liquid supply surface F2 and the ink ejection surface F1.

When the recovery operation of the recording heads 17*a* to 17*c* is performed, first as shown in FIG. 11, the control unit 110 (see FIG. 1) downwardly moves the first conveying unit 5 positioned below the recording portion 9. Then, the control unit 110 horizontally moves the wipe unit 19 positioned below the second conveying unit 12 so that it is positioned between the recording portion 9 and the first conveying unit 5.

(Cleaning Liquid Supply Operation)

As shown in FIG. 12, prior to the wiping operation (wipe operation described later), the control unit 110 (see FIG. 1) supplies the cleaning liquid 23 to the recording heads 17*a* to 17*c*. A predetermined amount of the supplied cleaning liquid 23 is supplied from the cleaning liquid supply ports 60*a* (see FIG. 6) to the cleaning liquid supply surface F2.

(Ink Extrusion Operation)

In addition, as shown in FIG. 12, prior to the wiping operation (wipe operation described later), the control unit 110 (see FIG. 1) supplies the ink 22 to the recording heads 17*a* to 17*c*. The supplied ink 22 is forcibly extruded (purged) from the ink ejection port 18*a*.

(Wipe Operation)

As shown in FIG. 13, the control unit 110 upwardly moves the wipers 35*a* to 35*c* at the position P1 just below the inclined surface 62 of the cleaning liquid supply member 60 of the recording heads 17*a* to 17*c* (position on the wiping direction upstream side (the right side in FIG. 13) of the cleaning liquid supply region R2). In this case, the wipers 35*a* to 35*c* are moved upward so that the upper surfaces of the wipers 35*a* to 35*c* become higher than the cleaning liquid supply surface F2 by approximately 1.5 mm. Note that when the wipers 35*a* to 35*c* are moved upward, the wipers 35*a* to 35*c* may or may not be pressed to contact with the inclined surface 62.

Figure 21:
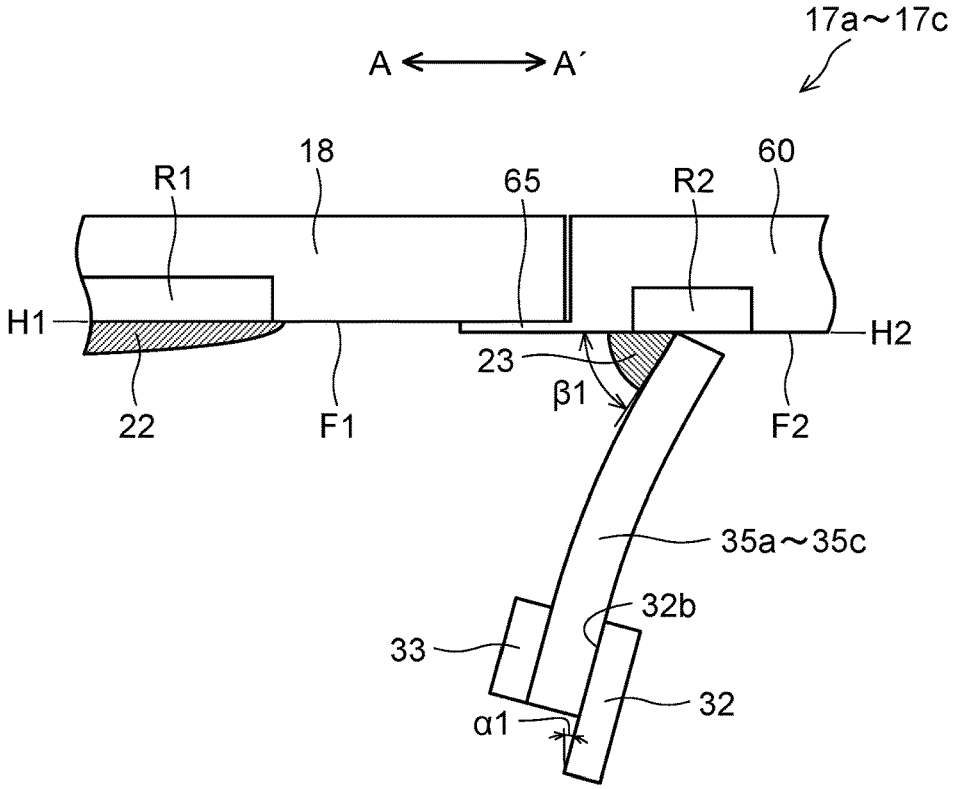
FIG. 21 is a diagram showing a state in which the wiper passes the cleaning liquid supply region of the inkjet recording apparatus of the second embodiment of the present disclosure.

From the state of FIG. 13, the control unit 110 horizontally moves the wipers 35*a* to 35*c* along the cleaning liquid supply surface F2 in a direction to the ink ejection region R1 (in the arrow A direction) as shown in FIGS. 14 and 21. In this way, after wiping off the cleaning liquid 23, the wipers 35*a* to 35*c* move in the direction to the ink ejection region R1 in the state holding the cleaning liquid 23. When the wipers 35*a* to 35*c* pass the cleaning liquid supply region R2, the wiper mounting surface 32*b* of the wiper holder stay 32 to which the wipers 35*a* to 35*c* are mounted is disposed to be inclined upward toward the wiping direction upstream side (the right side in FIG. 21). Specifically, the wiper mounting surface 32*b* is disposed to be inclined from the normal of the cleaning liquid supply surface F2 in an arrow A' direction by an angle of al (approximately 15 degrees), and a pressure contact angle 81 of the tips of the wipers 35*a* to 35*c* to the cleaning liquid supply surface F2 is approximately 60 degrees.

Figure 22:
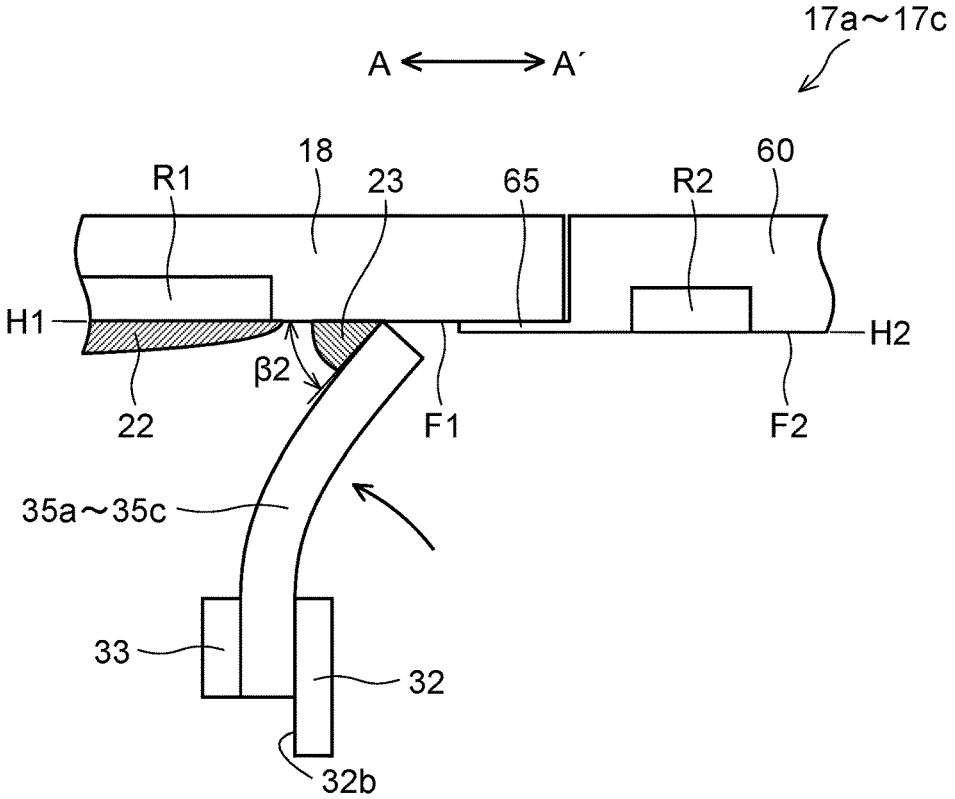
FIG. 22 is a diagram showing a state in which the wiper passes the step and after that the wiper holder stay is rotated by a predetermined angle in the inkjet recording apparatus of the second embodiment of the present disclosure.

Further, when the wipers 35*a* to 35*c* further moves in the left direction (in the arrow A direction) so as to pass the boundary part between the cleaning liquid supply surface F2 and the ink ejection surface F1, the control unit 110 rotates the wiper holder stay 32 in a counterclockwise direction by a predetermined angle in FIG. 22 (by approximately 10 to 20 degrees) as shown in FIG. 22 so that the pressure contact angle of the tips of the wipers 35*a* to 35*c* to the ink ejection surface F1 is decreased. Specifically, the wiper mounting surface 32*b* is disposed perpendicularly to the cleaning liquid ejection surface F1, and a pressure contact angle 82 of the tips of the wipers 35*a* to 35*c* to the cleaning liquid ejection surface F1 becomes approximately 45 degrees. In this way, the pressure contact angle 82 of the tips of the wipers 35*a* to 35*c* to the ink ejection surface F1 when wiping the ink ejection region R1 is smaller than the pressure contact angle 81 of the tips of the wipers 35*a* to 35*c* to the cleaning liquid supply surface F2 when passing the cleaning liquid supply region R2 by 10 to 20 degrees (15 degrees in this example). In addition, the contact pressing force of the wipers 35*a* to 35*c* to the ink ejection surface F1 is larger than the contact pressing force of the wipers 35*a* to 35*c* to the cleaning liquid supply surface F2.

After that, as shown in FIG. 17, the wipers 35*a* to 35*c* further move in the left direction (in the arrow A direction) on the ink ejection surface F1 while maintaining the state holding the cleaning liquid 23. Note that the pressure contact angle 82 of the tips of the wipers 35*a* to 35*c* to the ink ejection surface F1 when wiping the ink ejection region R1 is approximately 45 degrees. Then, the wipers 35*a* to 35*c* further move in the left direction (in the arrow A direction). When the wipers 35*a* to 35*c* reach the position P2 on the opposite side of the cleaning liquid supply region R2 with respect to the ink ejection region R1, the movement in the left direction is stopped.

(Separation Operation)

After the wipe operation is performed, as shown in FIG. 18, the control unit 110 downwardly moves the wipers 35*a* to 35*c* so that they are separated from the ink ejection surface F1.

Finally, the control unit 110 horizontally moves the wipe unit 19 disposed between the recording portion 9 and the first conveying unit 5 so that it is positioned below the second conveying unit 12, and the control unit 110 upwardly moves the first conveying unit 5 to a predetermined position. In this way, the recovery operation of the recording heads 17*a* to 17*c* is finished.

Other operations in the second embodiment are the same as those in the first embodiment described above.

In this embodiment, as described above, in the wipe operation, after the wipers 35*a* to 35*c* pass the cleaning liquid supply region R2, before they reach the ink ejection region R1, the control unit 110 rotates the wiper holder stay 32 so that the pressure contact angle of the tips of the wipers 35*a* to 35*c* to the ink ejection surface F1 is decreased. In other words, the pressure contact angle of the tips of the wipers 35*a* to 35*c* to the recording heads 17*a* to 17*c* is larger when the wipers 35*a* to 35*c* pass the cleaning liquid supply region R2 than when the wipers 35*a* to 35*c* wipe the ink ejection region R1. In this way, the contact pressing force of the wipers 35*a* to 35*c* to the cleaning liquid supply surface F2 when passing the cleaning liquid supply region R2 can be reduced, and hence the tips of the wipers 35*a* to 35*c* can be prevented from being damaged by the edge of the cleaning liquid supply port 60*a*.

In addition, as described above, the wiper mounting surface 32*b* of the wiper holder stay 32 is disposed to be inclined upward toward the wiping direction upstream side when the wipers 35*a* to 35*c* pass the cleaning liquid supply region R2, while it is disposed to be perpendicular to the ink ejection surface F1 when the wipers 35*a* to 35*c* pass the ink ejection region R1. In this way, the contact pressing force of the wipers 35*a* to 35*c* to the cleaning liquid supply surface F2 when passing the cleaning liquid supply region R2 can be easily reduced, and hence the tips of the wipers 35*a* to 35*c* can be easily prevented from being damaged by the edge of the cleaning liquid supply port 60*a*.

In addition, as described above, when the height position H2 of the cleaning liquid supply surface F2 is lower than the height position H1 of the ink ejection surface F1, the step is formed at the boundary part between the cleaning liquid supply surface F2 and the ink ejection surface F1, and hence the tips of the wipers 35*a* to 35*c* are apt to be damaged by the step more easily when the wipers 35*a* to 35*c* pass the step. Therefore, it is particularly effective to apply the present disclosure in the case where the height position H2 of the cleaning liquid supply surface F2 is lower than the height position H1 of the ink ejection surface F1.

In addition, as described above, the pressure contact angle 81 of the tips of the wipers 35*a* to 35*c* to the cleaning liquid supply surface F2 when wiping the cleaning liquid supply region R2 is larger than the pressure contact angle β2 of the tips of the wipers 35*a* to 35*c* to the ink ejection surface F1 when wiping the ink ejection region R1 by 10 to 20 degrees. In this way, the contact pressing force of the wipers 35*a* to 35*c* to the cleaning liquid supply surface F2 when wiping the cleaning liquid supply region R2 can be sufficiently decreased, and hence the tips of the wipers 35*a* to 35*c* can be sufficiently prevented from being damaged by the edge of the cleaning liquid supply port 60*a*.

Other effects of the second embodiment are the same as those in the first embodiment described above.

Third Embodiment

Figure 23:
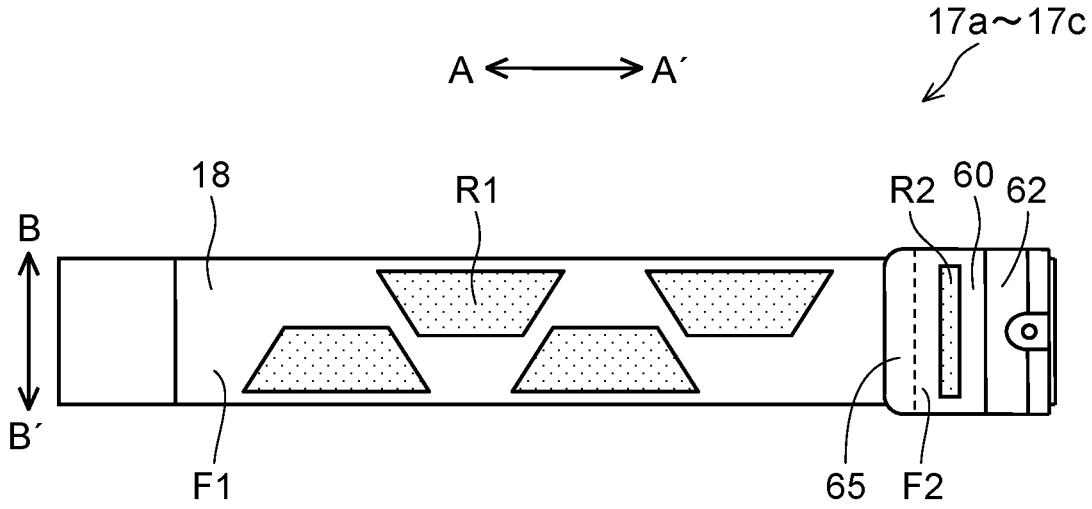
FIG. 23 is a diagram of the recording head of the inkjet recording apparatus of a third embodiment of the present disclosure, viewed from the ink ejection surface side.
Figure 24:
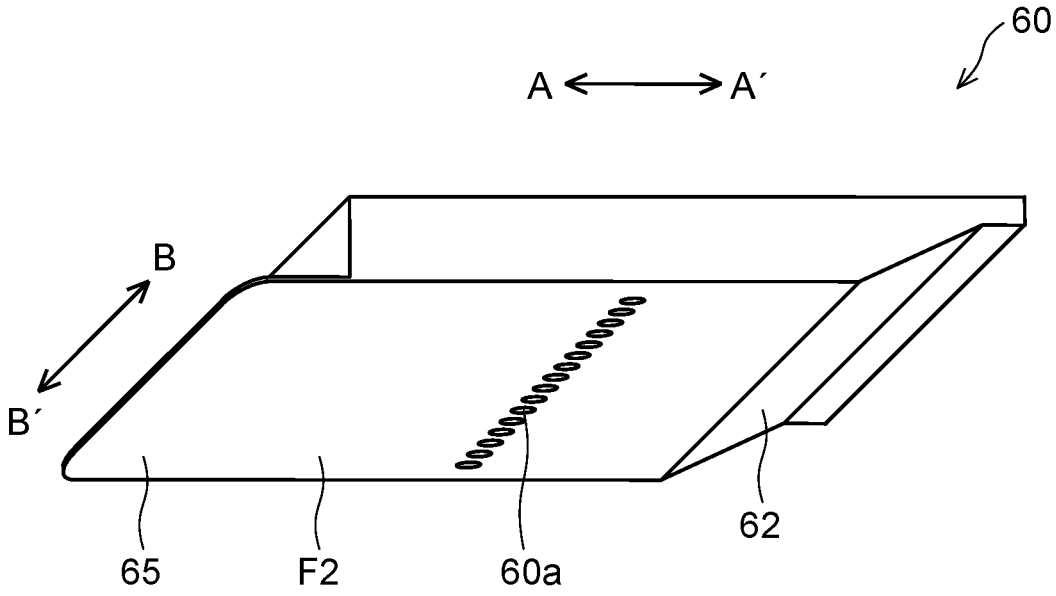
FIG. 24 is a diagram of the cleaning liquid supply member of the recording head of the inkjet recording apparatus of the third embodiment of the present disclosure, viewed from obliquely below.
Figure 25:
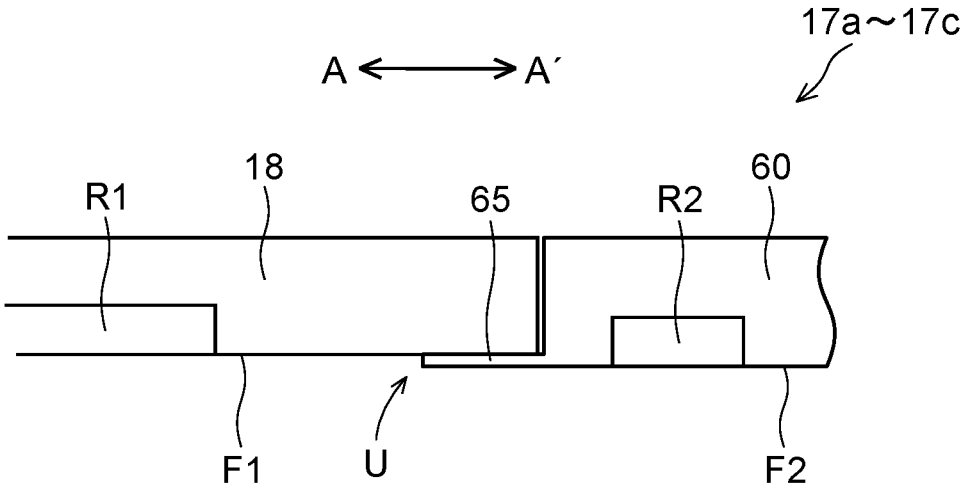
FIG. 25 is a diagram showing a structure of a boundary part between a head portion and the cleaning liquid supply member of the recording head of the inkjet recording apparatus of the third embodiment of the present disclosure.
Figure 26:
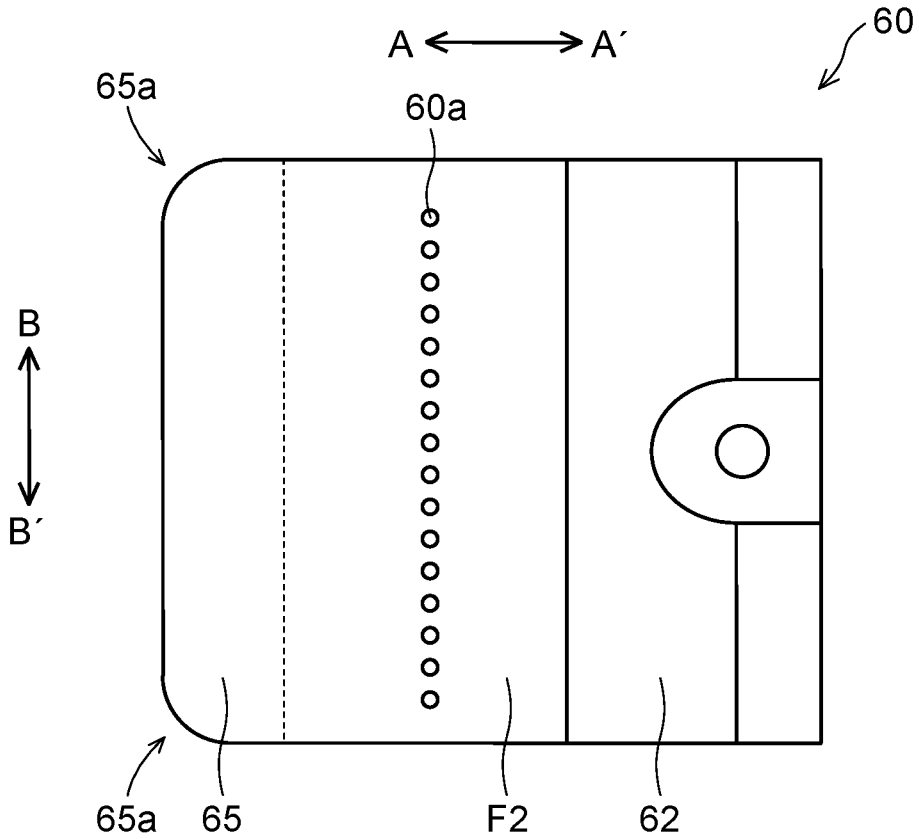
FIG. 26 is a diagram showing the cleaning liquid supply member of the recording head of the inkjet recording apparatus of the third embodiment of the present disclosure, viewed from below.

In the inkjet recording apparatus 100 of a third embodiment of the present disclosure, as shown in FIG. 23, the cleaning liquid supply member 60 has a lower surface (cleaning liquid supply surface) F2 including the cleaning liquid supply region R2 in which a plurality of the cleaning liquid supply ports 60*a* for supplying the cleaning liquid (see FIGS. 24 and 26) are arranged. The lower surface F2 is disposed in parallel to the ink ejection surface F1. As shown in FIG. 25, a step U is formed at a boundary part between the lower surface F2 and the ink ejection surface F1.

Figure 27:
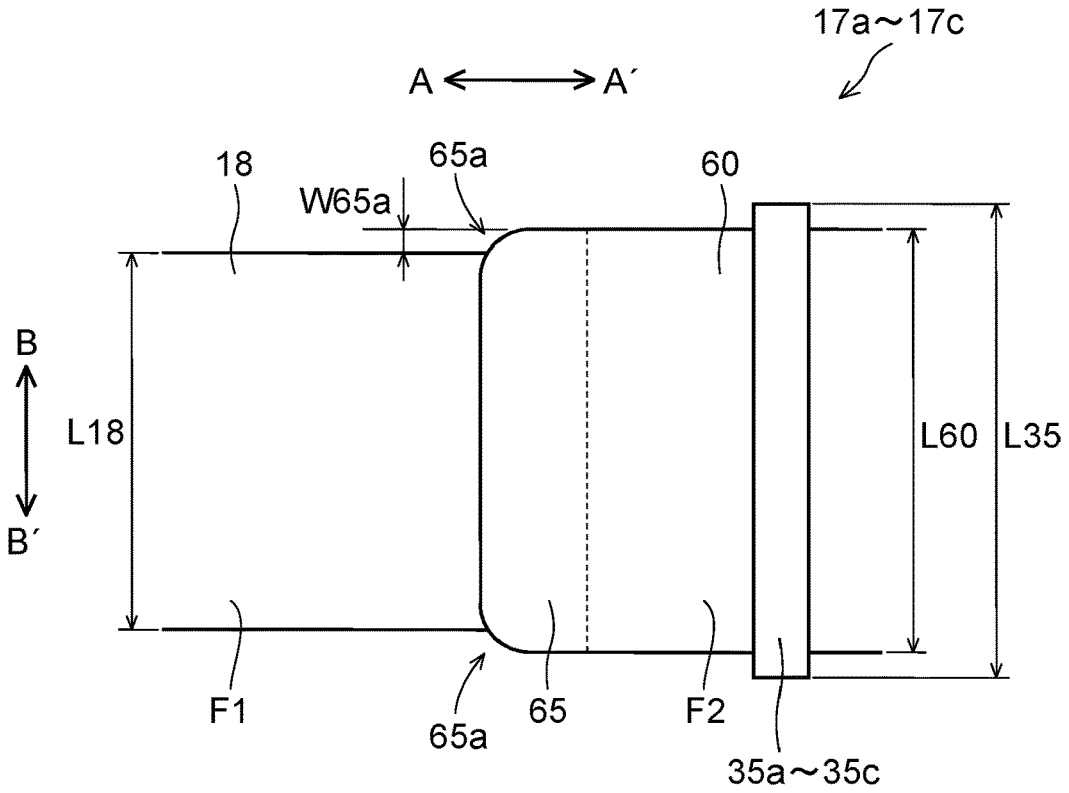
FIG. 27 is a diagram showing the boundary part between the head portion and the cleaning liquid supply member of the recording head of the inkjet recording apparatus of the third embodiment of the present disclosure, viewed from below.

As shown in FIG. 27, a length L60 in the head width direction (arrow BB' direction) of the lower surface F2 of the cleaning liquid supply member 60 is larger than a length L18 in the head width direction of the ink ejection surface F1 of the head portion 18 by approximately 1 mm. Therefore, the lower surface F2 protrudes from the ink ejection surface F1 in the head width direction on each side by a protrusion amount W65*a* (approximately 0.5 mm).

In addition, the length L60 in the head width direction of the lower surface F2 is smaller than the length L35 in the head width direction of the wipers 35*a* to 35*c* by approximately 1 mm. Therefore, the wipers 35*a* to 35*c* protrudes from the lower surface F2 in the head width direction on each side by approximately 0.5 mm.

An end of the lower surface F2 on the wiping direction downstream side (the left side in FIG. 27) is formed to have a round shape in a plan view and has no angular portion. Specifically, two corner portions 65*a* of the end of the lower surface F2 on the wiping direction downstream side are formed to have a round shape (fan shape having a central angle of 90 degrees) in a plan view. The radius of curvature of the corner portion 65*a* is larger than or equal to the protrusion amount W65*a* (approximately 0.5 mm) of the lower surface F2 from the ink ejection surface F1 in the head width direction.

In this embodiment, the recording heads 17*a* to 17*c*, the wipers 35*a* to 35*c*, the supply path 70, the cleaning liquid supply mechanism, and the like constitute the head cleaning mechanism.

Other structures of the third embodiment are the same as those in the first embodiment described above.

Next, the recovery operation of the recording heads 17*a* to 17*c* using the wipe unit 19 in the inkjet recording apparatus 100 of this embodiment is described. Note that in this embodiment, unlike the first embodiment described above, the wipers 35*a* to 35*c* are not moved upward when the wipers 35*a* to 35*c* pass the step U. In addition, in this embodiment, unlike the second embodiment described above, the wiper holder stay 32 is not rotated when the wipers 35*a* to 35*c* pass the step U.

When performing the recovery operation of the recording heads 17*a* to 17*c*, first as shown in FIG. 11, the control unit 110 (see FIG. 1) downwardly moves the first conveying unit 5 positioned below the recording portion 9. Then, the control unit 110 horizontally moves the wipe unit 19 positioned below the second conveying unit 12 so that it is positioned between the recording portion 9 and the first conveying unit 5.

(Cleaning Liquid Supply Operation)

Prior to the wiping operation (wipe operation described later), as shown in FIG. 12, the control unit 110 (see FIG. 1) supplies the cleaning liquid 23 to the recording heads 17*a* to 17*c*. A predetermined amount of the supplied cleaning liquid 23 is supplied from the cleaning liquid supply ports 60*a* (see FIG. 24) to the lower surface F2.

(Ink Extrusion Operation)

In addition, prior to the wiping operation (wipe operation described later), as shown in FIG. 12, the control unit 110 (see FIG. 1) supplies the ink 22 to the recording heads 17*a* to 17*c*. The supplied ink 22 is forcibly extruded (purged) from the ink ejection port 18*a*.

(Wipe Operation)

As shown in FIG. 13, the control unit 110 upwardly moves the wipers 35*a* to 35*c* at the position P1 just below the inclined surface 62 of the cleaning liquid supply member 60 of the recording heads 17*a* to 17*c* (position on the wiping direction upstream side (the right side in FIG. 13) of the cleaning liquid supply region R2). In this case, the wipers 35*a* to 35*c* is moved upward so that the upper surfaces of the wipers 35*a* to 35*c* become higher than the lower surface F2. Note that when the wipers 35*a* to 35*c* are moved upward, the wipers 35*a* to 35*c* may or may not be pressed to contact with the inclined surface 62.

From the state of FIG. 13, the control unit 110 horizontally moves the wipers 35*a* to 35*c* along the lower surface F2 in the direction to the ink ejection region R1 (in the arrow A direction) as shown in FIG. 14. In this way, the wipers 35*a* to 35*c* wipe off the cleaning liquid 23 and moves on the lower surface F2 in the direction to the ink ejection region R1 in the state holding the cleaning liquid 23.

After that, as shown in FIG. 17, the wipers 35*a* to 35*c* move in the left direction (in the arrow A direction) on the ink ejection surface F1 while maintaining the state holding the cleaning liquid 23. Further, the wipers 35*a* to 35*c* further move in the left direction (in the arrow A direction). When the wipers 35*a* to 35*c* reach the position P2 on the opposite side of the cleaning liquid supply region R2 with respect to the ink ejection region R1, the movement in the left direction is stopped.

(Separation Operation)

After the wipe operation is performed, as shown in FIG. 18, the control unit 110 downwardly moves the wipers 35*a* to 35*c* so as to be separated from the ink ejection surface F1.

Finally, the control unit 110 horizontally moves the wipe unit 19 disposed between the recording portion 9 and the first conveying unit 5 so that it is positioned below the second conveying unit 12, and the control unit 110 upwardly moves the first conveying unit 5 to a predetermined position. In this way, the recovery operation of the recording heads 17*a* to 17*c* is finished.

Other operations in the third embodiment are the same as those in the first embodiment described above.

In this embodiment, as described above, the recording heads 17*a* to 17*c* are constituted of the head portion 18 that ejects the ink 22, and the cleaning liquid supply member 60 that supplies the cleaning liquid 23. In this way, an ink passing path and a cleaning liquid passing path in the recording heads 17*a* to 17*c* can be formed in different members (the head portion 18 and the cleaning liquid supply member 60), and hence structures of the recording heads 17*a* to 17*c* can be prevented from being complicated.

In addition, the length L60 in the head width direction of the lower surface F2 of the cleaning liquid supply member 60 is larger than the length L18 in the head width direction of the ink ejection surface F1. In this way, even if the head portion 18 and the cleaning liquid supply member 60 are disposed to be shifted from each other in the head width direction, one end of the ink ejection surface F1 in the head width direction can be prevented from protruding from the lower surface F2 of the cleaning liquid supply member 60 in the head width direction. For this reason, the cleaning liquid 23 of the lower surface F2 can be supplied to the entire region in the head width direction of the ink ejection surface F1, and hence the ink ejection surface F1 can be cleaned over the entire region in the head width direction.

In addition, as described above, the length L35 in the head width direction of the wipers 35*a* to 35*c* is larger than the length L60 in the head width direction of the lower surface F2, and the two corner portions 65*a* of the end of the lower surface F2 on the wiping direction downstream side are formed to have a round shape in a plan view. In this way, when the wipers 35*a* to 35*c* move from the lower surface F2 to the ink ejection surface F1, the wipers 35*a* to 35*c* can be prevented from being damaged by the corner portion 65*a* of the lower surface F2. Note that when the corner portion 65*a* is formed in a right angle in a plan view, the corner portion 65*a* may damage the wipers 35*a* to 35*c* so that ends of the wipers 35*a* to 35*c* in the head width direction may be cut along the wiping direction.

In addition, when the thin plate portion 65 of the cleaning liquid supply member 60 is disposed to overlap under an end of the ink ejection surface F1, i.e., when the lower surface F2 is disposed under the ink ejection surface F1, the contact pressing force of the wipers 35*a* to 35*c* to the lower surface F2 becomes larger than the contact pressing force of the wipers 35*a* to 35*c* to the ink ejection surface F1. For this reason, when the wipers 35*a* to 35*c* move from the lower surface F2 to the ink ejection surface F1, the wipers 35*a* to 35*c* are apt to be damaged by the corner portion 65*a* of the lower surface F2. Therefore, it is particularly effective to form the end of the lower surface F2 in the wiping direction downstream side to have a round shape in the structure in which the lower surface F2 is disposed under the ink ejection surface F1.

In addition, as described above, a radius of curvature of the corner portion 65*a* is larger than or equal to the protrusion amount W65*a* of the lower surface F2 from the ink ejection surface F1 in the head width direction. In this way, the round shape of the corner portion 65*a* can be large, and hence the wipers 35*a* to 35*c* can be prevented from being damaged by the corner portion 65*a*.

Other effects of the third embodiment are the same as those in the first embodiment described above.

Note that the embodiments disclosed in this specification are merely examples in every aspect and should not be interpreted as limitations. The scope of the present disclosure is defined not by the above description of the embodiments but by the claims and should be understood to include all modifications within meanings and scopes equivalent to the claims.

For example, in the first and second embodiments described above, the cleaning liquid supply member 60 including the cleaning liquid supply region R2 in which the cleaning liquid supply ports 60*a* are formed is disposed separately from the head portion 18 as an example, but the present disclosure is not limited to this. It is possible to adopt a structure in which the cleaning liquid supply member 60 is not disposed, and the cleaning liquid supply region R2 in which the cleaning liquid supply ports 60*a* are formed is disposed in the head portion 18.

In addition, in the embodiments described above, the cleaning liquid supply operation is performed before the wipe operation as an example, but it may be performed simultaneously with the wipe operation as long as before the wipers 35*a* to 35*c* enter the cleaning liquid supply region R2. In addition, the ink extrusion operation is performed before the wipe operation in the example, but it may be performed simultaneously with the wipe operation as long as before the wipers 35*a* to 35*c* enter the ink ejection region R1.

In addition, in the embodiments described above, the cleaning liquid 23 and the ink (purged ink) 22 are used for performing the recovery operation of the recording heads 17*a* to 17*c*, but only the cleaning liquid 23 may be used for performing the recovery operation of the recording heads 17*a* to 17*c*. In other words, the ink extrusion operation may not be performed.

In addition, in the embodiments described above, the step is formed between the cleaning liquid supply surface F2 and the ink ejection surface F1 as an example, but the present disclosure is not limited to this. In other words, the cleaning liquid supply surface F2 and the ink ejection surface F1 may be flush with each other.

In addition, in the third embodiment described above, the cleaning liquid supply region R2 in which the cleaning liquid supply ports 60*a* are formed is disposed in the lower surface F2 as an example, but it may be disposed in the inclined surface 62. In this case, the cleaning liquid 23 supplied to the inclined surface 62 flows along the inclined surface 62 to the lower surface F2, and hence the wipers 35*a* to 35*c* can wipe off the cleaning liquid 23. Note that the cleaning liquid supply surface is constituted of the inclined surface 62 and the lower surface F2.

Figure 28:
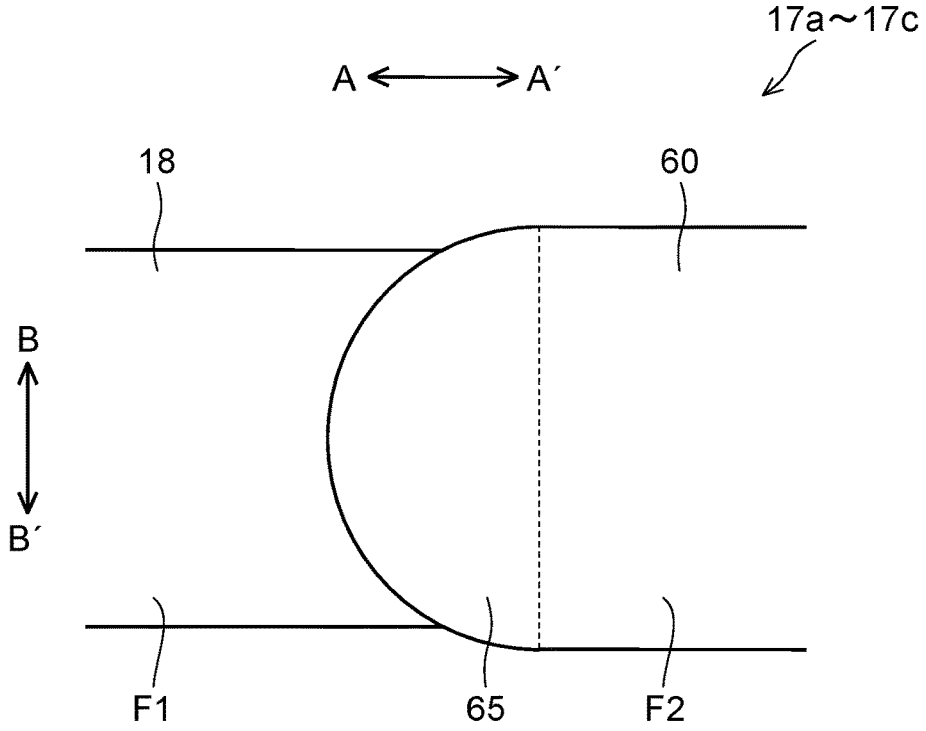
FIG. 28 is a diagram showing the boundary part between the head portion and the cleaning liquid supply member of the recording head of a variation of the third embodiment of the present disclosure, viewed from below.

In addition, in the third embodiment described above, the two corner portions 65*a* of the end of the lower surface F2 in the wiping direction downstream side are formed to have a round shape in a plan view as an example, but the present disclosure is not limited to this. For example, like the recording heads 17*a* to 17*c* shown in FIG. 28 of a variation of the third embodiment of the present disclosure, the end of the lower surface F2 in the wiping direction downstream side may be formed to have a semicircular shape in a plan view. With this structure, the round shape of the end of the lower surface F2 in the wiping direction downstream side can be larger, and hence the wipers 35*a* to 35*c* can be more prevented from being damaged. In addition, the wipers 35*a* to 35*c* gradually contact (abut) with the ink ejection surface F1 until the middle part in the head width direction passes the step U, and hence the wipers 35*a* to 35*c* can be prevented from leaping when they contact with the ink ejection surface F1. Therefore, the cleaning liquid 23 can be prevented from remaining at the step U.

What is claimed is:

1. A recording head recovery system comprising:

a recording head including an ink ejection surface provided with an ink ejection region in which a plurality of ink ejection ports are formed for ejecting ink onto a recording medium;

a wiper configured to wipe the ink ejection surface in a predetermined direction;

a wiper holding member for holding the wiper and moving the same along the ink ejection surface, the wiper holding member being capable of rotating about a rotation shaft extending in a head width direction perpendicular to a wiping direction in which the wiper wipes the ink ejection surface;

a rotation mechanism for rotating the wiper holding member about the rotation shaft; and a control unit for controlling the rotation mechanism, wherein the recording head includes a cleaning liquid supply region disposed on an upstream side in the wiping direction of the ink ejection region, the cleaning liquid supply region in which a plurality of cleaning liquid supply ports for supplying cleaning liquid are formed, the control unit is capable of performing a recovery operation of the recording head including a cleaning liquid supply operation for supplying the cleaning liquid from the cleaning liquid supply ports, and a wipe operation for wiping the ink ejection surface with the wiper in a state holding the cleaning liquid, by moving the wiper from a position on the wiping direction upstream side of the cleaning liquid supply region to a position on the wiping direction downstream side of the ink ejection region, and in the wipe operation, the control unit rotates the wiper holding member so that a pressure contact angle of a tip of the wiper to the ink ejection surface is decreased after the wiper passes the cleaning liquid supply region before reaching the ink ejection region.

2. The recording head recovery system according to claim 1, wherein an opening diameter of the cleaning liquid supply port is larger than an opening diameter of the ink ejection port.

3. The recording head recovery system according to claim 1, wherein the wiper holding member has a wiper mounting surface to which the wiper is mounted, and the wiper mounting surface is disposed to be inclined upward toward the wiping direction upstream side when the wiper passes the cleaning liquid supply region, and is disposed to be perpendicular to the ink ejection surface when the wiper passes the ink ejection region.

4. The recording head recovery system according to claim 1, wherein the recording head is constituted of an ink ejection head portion including the ink ejection surface and a cleaning liquid supplying head portion including a cleaning liquid supply surface provided with the cleaning liquid supply region, and a height position of the cleaning liquid supply surface is lower than a height position of the ink ejection surface.

5. The recording head recovery system according to claim 4, wherein a part on the wiping direction downstream side of the cleaning liquid supplying head portion is formed to have a thin plate-like shape and is disposed to overlap under an end of the ink ejection surface.

6. The recording head recovery system according to claim 1, wherein a pressure contact angle of the tip of the wiper to a surface provided with the cleaning liquid supply region when passing the cleaning liquid supply region is larger than the pressure contact angle of the tip of the wiper to the ink ejection surface when wiping the ink ejection region by 10 to 20 degrees.

7. An inkjet recording apparatus comprising the recording head recovery system according to claim 1.

* * * * *